US010438522B2

(12) United States Patent
Hur et al.

(10) Patent No.: US 10,438,522 B2
(45) Date of Patent: Oct. 8, 2019

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Se Huhn Hur, Yongin-si (KR); Gyu Hyeon Kim, Suwon-si (KR); Ji Hoon Kim, Seoul (KR); Hyeon Jin Kim, Tongyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 302 days.

(21) Appl. No.: 14/820,458

(22) Filed: Aug. 6, 2015

(65) Prior Publication Data

US 2016/0180789 A1 Jun. 23, 2016

(30) Foreign Application Priority Data

Dec. 22, 2014 (KR) ..... 10-2014-0186114

(51) Int. Cl.
*G09G 3/00* (2006.01)
*G09G 3/36* (2006.01)

(52) U.S. Cl.
CPC ..... *G09G 3/003* (2013.01); *G09G 3/3614* (2013.01); *G09G 3/3648* (2013.01); *G09G 2310/0205* (2013.01); *G09G 2320/0252* (2013.01)

(58) Field of Classification Search
None
See application file for complete search history.

(56) References Cited

U.S. PATENT DOCUMENTS 5,596,684 A * 1/1997 Ogletree ..... G06K 15/00 345/611
5,630,026 A * 5/1997 Ogletree ..... G06K 15/12 347/112
5,910,805 A * 6/1999 Hickey ..... G09G 5/28 345/467
6,072,510 A * 6/2000 Ogletree ..... G06K 15/1223 347/131

(Continued)

FOREIGN PATENT DOCUMENTS

KR 10-2001-0013036 A 2/2001
KR 10-2007-0115599 A 12/2007

(Continued)

*Primary Examiner* — William Boddie
*Assistant Examiner* — Bipin Gyawali
(74) *Attorney, Agent, or Firm* — Lewis Roca Rothgerber Christie LLP

(57) ABSTRACT

A driving method of a display device includes: generating output image data by the signal controller by either reducing vertical resolution of input image data of one frame by 1/k (k is a natural number) or receiving input image data with its vertical resolution reduced by 1/k and processing the input image data to generate output image data; generating a data voltage based on the output image data by the data driver to apply the data voltage to the data line; and applying gate-on voltage pulses to k adjacent gate lines by the gate driver corresponding to respective image data of the output image data, wherein the output image data corresponding to some pixel rows of the output image data are shifted to left or right by at least one pixel and are output to the data driver in a first frame.

21 Claims, 18 Drawing Sheets

(56) References Cited

U.S. PATENT DOCUMENTS

| | | | | |
|---|---|---|---|---|
| 8,295,429 | B2 * | 10/2012 | Sasaki | H04N 5/3591 377/62 |
| 8,698,722 | B2 * | 4/2014 | Baek | G11C 19/28 345/100 |
| 2002/0180768 | A1 * | 12/2002 | Lam | G09G 1/28 345/698 |
| 2003/0169247 | A1 * | 9/2003 | Kawabe | G09G 3/342 345/204 |
| 2009/0244041 | A1 * | 10/2009 | Choe | G09G 3/3659 345/211 |
| 2010/0045782 | A1 * | 2/2010 | Morita | H04N 13/004 348/51 |

FOREIGN PATENT DOCUMENTS

| | | | |
|---|---|---|---|
| KR | 10-2008-0014331 | A | 2/2008 |
| TW | 200822022 | A | 5/2008 |
| TW | 200929167 | A | 7/2009 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2014-0186114, filed in the Korean Intellectual Property Office on Dec. 22, 2014, the entire contents of which are incorporated herein by reference.

BACKGROUND

1. Field

The present invention relates to a display device and a driving method thereof.

2. Description of the Related Art

Display devices such as a liquid crystal display (LCD), an organic light emitting diode (OLED) display, and the like generally include a display panel and driving devices for driving the display panel.

The display panel includes a plurality of signal lines and a plurality of pixels that are connected thereto and arranged in an approximate matrix form.

The signal lines include a plurality of gate lines for transmitting a gate signal, a plurality of data lines for transmitting a data voltage, and the like.

Each pixel may include at least one switching element connected to the corresponding gate and data lines, at least one pixel electrode connected thereto, and a facing electrode facing the pixel electrode and applied with a common voltage.

The switching element may include at least one thin film transistor, and may be turned on or turned off according to the gate signal transmitted through the gate line, such that the data voltage transmitted through the data line is selectively transmitted to a pixel electrode.

Each pixel is applied with the data voltage corresponding to desired luminance information via the switching element.

A pixel voltage is represented as a difference between the data voltage applied to the pixel and the common voltage applied to the facing electrode, and each pixel displays luminance that a gray level of the image signal represents according to the pixel voltage.

The driving devices of the display device include a graphics controller, drivers, and a signal controller for controlling the drivers.

The graphics controller transmits input image data for an image to be displayed to the signal controller.

The input image data contains luminance information of each pixel, and each luminance has a predetermined number of gray levels.

The signal controller generates control signals for driving the display panel to transmit them, along with the image data, to the drivers.

The drivers include a gate driver for generating the gate signal and a data driver for generating the data voltage.

In order for the pixel to display the image of the desired luminance at an appropriate time, a charge rate of the pixel should be secured, and for this purpose, a gate doubling technique may be used.

A gate doubling driving may enable a frame rate to at least double by outputting reduced image data rather than data of all rows and concurrently (e.g., simultaneously) driving two or more gate lines for at least some time.

Accordingly, for the same input image data, output image data may be continuously input multiple times to the display panel, thereby improving a response speed of the pixel and reducing crosstalk between adjacent frames.

However, because the output image data is reduced image, vertical resolution may be degraded.

The double gate driving can be used not only in a 2D image display, but also in a 3D image or multi-view image display.

In general, in 3D image display technology, binocular parallax, which is the biggest factor for recognizing the 3D effect at a short distance, is used to realize a 3D effect of an object.

That is, when different 2D images are reflected on a left eye and a right eye such that the image reflected on the left eye (hereafter referred to as a "left eye image") and the image reflected on the right eye (hereafter referred to as a "right eye image") are transmitted to a brain, the left and right eye images are perceived as a 3D stereoscopic image with depth perception.

The display device for displaying the 3D images using such binocular disparity may be classified into a stereoscopic 3D image display device using glasses such as shutter glasses, polarized glasses, or the like, and an autostereoscopic 3D image display device in which an optical system including a lenticular lens, a parallax barrier, and the like are included instead of using glasses.

When the stereoscopic 3D image display device using the shutter glasses and the like displays the 3D image, crosstalk between adjacent frames may increase because the frame for displaying the left eye image and the frame for displaying the right eye image are separately and alternately displayed.

In this case, when the double gate driving is used to drive the display panel, a faster response speed of the pixel and reduced crosstalk between the adjacent frames may be ensured because the same image data can be repeatedly input to the display panel with a faster frame rate.

This can identically be applied to a multiview display device for displaying different images to viewers at a plurality of viewpoints and to the 3D image display device.

The above information disclosed in this Background section is only for enhancement of understanding of the background of the invention and therefore it may contain information that does not form the prior art that is already known in this country to a person of ordinary skill in the art.

SUMMARY

Vertical resolution of output image data outputted to a display panel when gate-doubling driving is set to ON may be approximately ½ or below compared with that of output image data when the gate-doubling driving is set to OFF.

Accordingly, when edges of a specific shape consist of a curved line such as a circle or an oblique line, the corresponding edges of the image may not look smooth but look rough like a sawtooth pattern.

This is called an aliasing effect.

Such an aliasing effect may be a main factor that causes resolution of an image for one frame to be degraded, thereby deteriorating quality of the image.

Aspects of embodiments of the present invention may make the edges of images smoother by reducing the aliasing effect that can occur as the vertical resolution is reduced.

In addition, aspects of embodiments of present invention may include a display device that is capable of suppressing resolution degradation by displaying image data containing a larger amount of information, and a driving method thereof. Further, aspects of embodiments of the present invention may include a display device that is capable of improving side visibility by making a moving vertical line, which is recognized when it is driven with its polarities reversed and a specific image moves at a specific speed, undistinguishable or imperceptible by viewers.

According to example embodiments of the present invention, in a driving method of a display device, the display device including: a plurality of gate lines; a plurality of data lines; a plurality of pixels comprising switching elements coupled to the gate and data lines; a data driver; a gate driver; and a signal controller configured to control the data driver and the gate driver, the method includes: generating output image data by the signal controller by either reducing vertical resolution of input image data of one frame by 1/k (k is a natural number) or receiving input image data with its vertical resolution reduced by 1/k and processing the input image data to generate output image data; generating a data voltage based on the output image data by the data driver to apply the data voltage to the data line; and applying gate-on voltage pulses to k adjacent gate lines by the gate driver corresponding to respective image data of the output image data, wherein the output image data corresponding to some pixel rows of the output image data are shifted to left or right by at least one pixel and are output to the data driver in a first frame.

The output image data corresponding to a predetermined number of pixel rows may be shifted left or right by at least one pixel and are output to the data driver.

The predetermined number of the pixel rows may be 2k (k is a natural number of 1 or more).

The output image data may be shifted left or right for the first frame.

A frame where the output image data is shifted left and a frame where the output image data is shifted right may be alternated by at least one frame.

In a second frame, the output image data corresponding to the pixels rows may not be shifted left or right.

The first frame and the second frame may be alternated by at least one frame.

A frame where the output image data are shifted left, a frame where the output image data are shifted right, and the second frame may be alternated.

For the first frame, the output image data shifted left and the output image data shifted right among the output data shifted in the first frame may be alternated in a column direction.

In a second frame, the output image data corresponding to the pixels rows may not be shifted left or right.

The first frame and the second frame may be alternated by at least one frame.

In the first frame, the gate-on voltage pulses may be applied to at least two of the k adjacent gate lines at different times.

The output image data may include first output image data and second output image data that are sequentially output, the k adjacent gate lines for transmitting the gate-on voltage pulses corresponding to the first output image data may include a first gate line and a second gate line, the k adjacent gate lines for transmitting the gate-on voltage pulses corresponding to the second output image data may include a third gate line and a fourth gate line, and a time at which the gate-on voltage pulse begins to be applied to the second gate line may be between a time at which the gate-on voltage pulse begins to be applied to the first gate line and a time at which the gate-on voltage pulse begins to be applied to the third gate line.

The first gate line may transmit the gate-on voltage pulse while being synchronized with an output time of the first output image data, and the third gate line may transmit the gate-on voltage pulse while being synchronized with an output time of the second output image data.

The output image data may include reduced data of odd-numbered rows or reduced interpolated data of the odd-numbered rows, the reduced data of the odd-numbered rows may be generated by extracting the odd-numbered rows of the input image data, and the reduced interpolated data of the odd-numbered rows may be generated by interpolating input image data of even-numbered rows before the odd-numbered rows and the input image data of the even-numbered rows after the odd-numbered rows.

Lengths of overlap periods of the gate-on voltage pulse applied to the second gate line and the gate-on voltage pulse applied to the first gate line may be different in adjacent frames.

According to example embodiments of the present invention, a display device includes: a plurality of gate lines and a plurality of data lines; a plurality of pixels comprising switching elements coupled to the gate and data lines; a signal controller configured to generate output image data by reducing vertical resolution of input image data of one frame to 1/k (k is a natural number) or receiving input image data with the vertical resolution reduced by 1/k and processing the input image data to generate output image data; a data driver configured to generate a data voltage based on the output image data to apply the data voltage to the data line; and a gate driver configured to apply a gate-on voltage pulse to k adjacent gate lines corresponding to respective image data of the output image data, wherein the signal controller shifts the output image data corresponding to some pixel rows of the output image data left or right by at least one pixel to output it to the data driver in a first frame.

The output image data corresponding to a predetermined number of pixel rows may be shifted left or right by at least one pixel and may be output to the data driver.

The predetermined number of the pixel rows may be 2k pixel rows (k is a natural number of 1 or more).

In the first frame, the gate-on voltage pulse is applied to at least two gate lines of the k adjacent gate lines at different times.

The output image data may include first output image data and second output image data that are sequentially outputted, the k adjacent gate lines for transmitting the gate-on voltage pulses corresponding to the first output image data may include a first gate line and a second gate line, the k adjacent gate lines for transmitting the gate-on voltage pulses corresponding to the second output image data comprises a third gate line and a fourth gate line, and a time at which the gate-on voltage pulse begins to be applied to the second gate line may be between a time at which the gate-on voltage pulse begins to be applied to the first gate line and a time at which the gate-on voltage pulse begins to be applied to the third gate line.

According to example embodiments of the present invention, the aliasing effect generated as a result of the reduced vertical resolution at the gate-doubling driving of the display device can be reduced to make the edges of the image look smooth and to suppress resolution degradation even if the image data with the larger amount of information is displayed.

Further, the side visibility may be improved by making a moving vertical line, which is recognized when the display device is driven with its polarity inverted and the specific image moves at the specific speed, unrecognizable or imperceptible by viewers.

DETAILED DESCRIPTION

Figure 1:
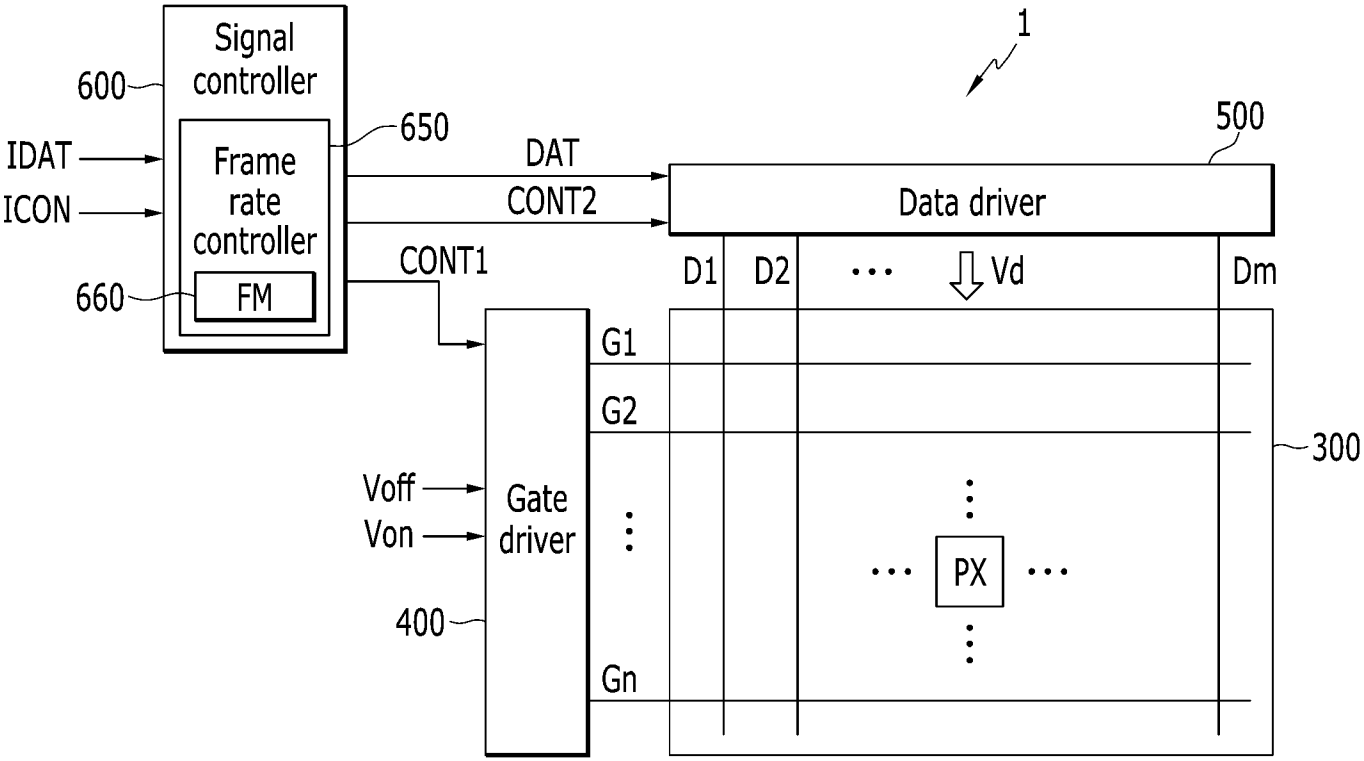
FIG. 1 is a block diagram of a display device according to an example embodiment of the present invention, FIGS. 2 and 3 respectively illustrate output image data and a gate signal inputted to a display panel for one frame when the display device according to the example embodiment of the present invention is driven with a gate doubling set to OFF, FIGS. 4 and 5 respectively illustrate the output image data and the gate signal inputted to the display panel for one frame when the display device according to the example embodiment of the present invention is driven with the gate doubling set to ON, FIG. 6 is a drawing for illustrating an image with an aliasing effect that is reduced according to a driving method of a display device according to an example embodiment of the present invention, FIGS. 7 and 8 respectively illustrate output image data and a gate signal received by a display panel for one frame when a display device according to an example embodiment of the present invention is driven with the gate doubling set to ON, FIG. 9 illustrates how a moving vertical line generated when the display device according to the example embodiment of the present invention displays a specific image is removed by the driving method of the display device according to the example embodiment of the present invention, FIGS. 10 and 11 respectively illustrate output image data and a gate signal received by a display panel for one frame when a display device according to an example embodiment of the present invention is driven with the gate doubling set to ON, FIGS. 12 to 16 respectively illustrate output image data and a gate signal received by a display panel for one frame when a display device according to an example embodiment of the present invention is driven with the gate doubling set to ON, FIG. 17 is a block diagram of the display device according to the example embodiment of the present invention.

The present invention will be described more fully hereinafter with reference to the accompanying drawings, in which example embodiments of the invention are shown.

As those skilled in the art would realize, the described embodiments may be modified in various different ways, all without departing from the spirit or scope of the present invention.

In the drawings, the thickness of layers, films, panels, regions, etc. are exaggerated for clarity.

Like reference numerals designate like elements throughout the specification.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout this specification and the claims that follow, when it is described that an element is "coupled" or "connected" to another element, the element may be "directly coupled" or "directly connected" to the other element or "electrically coupled" or "electrically connected" to the other element through a third element.

Further, unless explicitly described to the contrary, the word "comprise" and variations such as "comprises" or "comprising" will be understood to imply the inclusion of stated elements but not the exclusion of any other elements.

First, a display device according to an example embodiment of the present invention and a driving method thereof will be described with reference to FIGS. 1 to 5.

Referring to FIG. 1, the display device 1 according to the example embodiment of the present invention includes a display panel 300, a gate driver 400, and a data driver 500 that are connected to the display panel 300, and a signal controller 600.

When viewed as an equivalent circuit, the display panel 300 includes a plurality of signal lines and a plurality of pixels PX connected thereto.

The plurality of pixels PX may be arranged in an approximate matrix arrangement.

When the display device according to the example embodiment of the present invention is a liquid crystal display (LCD), the display panel 300 may include at least one substrate and a sealed liquid crystal layer.

The signal lines include a plurality of gate lines G1 to Gn for transmitting a gate signal and a plurality of data lines D1 to Dm for transmitting a data voltage Vd.

The gate lines G1 to Gn may extend in a row direction, while the data lines D1 to Dm may extend in a column direction.

The pixel PX may include at least one switching element connected to at least one of the data lines D1 to Dm and at least one of the gate lines G1 to Gn, and at least one pixel electrode connected to the switching element(s).

The switching element may include at least one thin film transistor, and may be controlled by the gate signal transmitted through the gate lines G1 to Gn to transmit the data voltage Vd transmitted through the data lines D1 to Dm to the pixel electrode.

In order to realize color display, each pixel PX may display one of primary colors (spatial division) or alternately display primary colors over time (temporal division), such that a desired color is recognized as a spatial or temporal sum of these primary colors.

The signal controller 600 receives input image data IDAT and an input control signal ICON from the outside such as from a graphics controller and the like to control an operation of the display panel 300.

The input image data IDAT contains luminance information, and luminance may have a predetermined number of gray levels.

The input control signal ICON may include a vertical synchronization signal Vsync, a horizontal synchronization signal Hsync, a main clock signal MCLK, a data enable signal DE, and the like that are associated with image display.

According to another example embodiment of the present invention, the input control signal ICON may further include frame rate information.

The signal controller 600 generates output image data DAT by appropriately processing the input image data IDAT based on the input image data IDAT and the input control signal ICON in accordance with an operating condition of the display panel 300, and generates a gate control signal CONT1, a data control signal CONT2, and the like.

The signal controller 600 transmits the gate control signal CONT1 to the gate driver 400, and transmits the data control signal CONT2 and the output image data DAT to the data driver 500.

The signal controller 600 according to the example embodiment of the present invention may further include a frame rate controller 650.

The frame rate controller 650 controls a frame rate based on the input image data IDAT.

The frame rate can be defined as the number of frames per second (referred to as a "frame frequency") displayed by the display panel 300.

Depending on a determination result of the frame rate controller 650, the signal controller 600 may generate the gate control signal CONT1, the data control signal CONT2, and the like.

The signal controller 600 may further include a frame memory 660 for storing the input image data IDAT in frame units.

The gate driver 400 is connected to the gate lines G1 to Gn.

The gate driver 400 may receive the gate control signal CONT1 from the signal controller 600, and based on the gate control signal CONT1, may sequentially apply the gate signal consisting of a gate-on voltage Von and a gate-off voltage Voff to units of at least one of the gate lines G1 to Gn in the column direction.

The gate driver 400 operates the k adjacent gate lines G1 to Gn (k is a natural number of 2 or more) according to output timing of each output image data DAT such that the gate-on voltages Von may overlap at least for some time, and such that the voltage Vd corresponding to the corresponding output image data DAT is applied to the pixels PX connected to the corresponding gate lines G1 to Gn.

This is called gate doubling driving, and a normal charging rate of the pixel PX can be secured through the gate doubling driving.

Though called gate doubling driving, it is not necessarily limited to a method of concurrently (e.g., simultaneously) operating a pair of gate lines, and may include a method of pairing three or more gate lines for a concurrent (e.g., simultaneous) operation.

In comparison with the gate doubling driving, a method of independently operating each of the gate lines G1 to Gn is called gate doubling-off driving.

When operated in the gate doubling driving, a scanning time for sequentially applying the gate-on voltage Von to the gate lines G1 to Gn of the entire display panel 300 may be reduced by 1/k, that is, ½, ⅓, and so on, compared with that operated in the gate doubling-off driving, and therefore the frame rate may be increased by k times, that is, 2 times, 3 times, or more.

Instead of increasing the frame rate, the charging time of the pixels connected to each of the gate lines G1 to Gn may be increased to secure an additional charging rate.

The data driver 500 is connected to the data lines D1 to Dm.

The data driver 500 receives the output image data DAT and the data control signal CONT2 from the signal controller 600, and generates the data voltage Vd to apply it to the data lines D1 to Dm.

The data voltage Vd may be selected from a plurality of gray-level voltages.

The data driver 500 may receive all of the gray-level voltages from a separate gray-voltage generator, or alternatively, may receive a limited number of reference gray-level voltages and generate the gray-level voltages for all gray levels by dividing them.

When operated by the gate doubling driving, the two or more adjacent gate lines G1 to Gn are concurrently (e.g., simultaneously) operated for at least some time to transmit the gate-on voltage Von, and the same data voltage Vd is applied to the pixels PX that are connected to the concurrently (e.g., simultaneously) operated gate lines G1 to Gn.

When operated in the gate doubling driving, the signal controller 600 may reduce vertical resolution of the input image data IDAT by 1/k (k is a natural number), or may receive and then process the input image data IDAT with the vertical resolution reduced by 1/k to generate the output image data DAT.

For example, the signal controller 600 may generate the output image data DAT with the vertical resolution reduced to ½ by extracting only the odd-numbered or even-numbered rows of the input image data IDAT.

The output image data DAT generated by extracting only the odd-numbered rows of the input image data IDAT is called reduced data for the odd-numbered rows.

The output image data DAT generated by extracting only the even-numbered rows of the input image data IDAT is called reduced data for the even-numbered rows.

Alternatively, the signal controller 600 may generate the reduced output image data DAT by interpolating the input image data IDAT corresponding to the at least two adjacent rows of the pixels PX with an average and the like.

That is, the output image data DAT for one odd-numbered row may be obtained by interpolation such as an average of the input image data IDAT of the previous even-numbered row and the input image data IDAT of the next even-numbered row, and is called reduced interpolation data for the odd-numbered rows.

Similarly, the output image data DAT for one even-numbered row may be obtained by interpolation such as an average of the input image data IDAT of the previous odd-numbered row and the input image data IDAT of the next odd-numbered row, and is called reduced interpolation data for the even-numbered rows.

According to another example embodiment of the present invention, instead of generating the output image data DAT by reducing the image data of the original resolution, the signal controller 600 may include the image data in which the input image data IDAT itself is reduced, and in this case, the signal controller 600 may appropriately process the reduced input image data IDAT in accordance with conditions of the display panel 300 and the data driver 500, thereby generating the output image data DAT.

Prior to describing a driving method of a display device according to an example embodiment of the present invention, the gate doubling-off driving will be described with reference to FIGS. 2 and 3.

Figure 2:
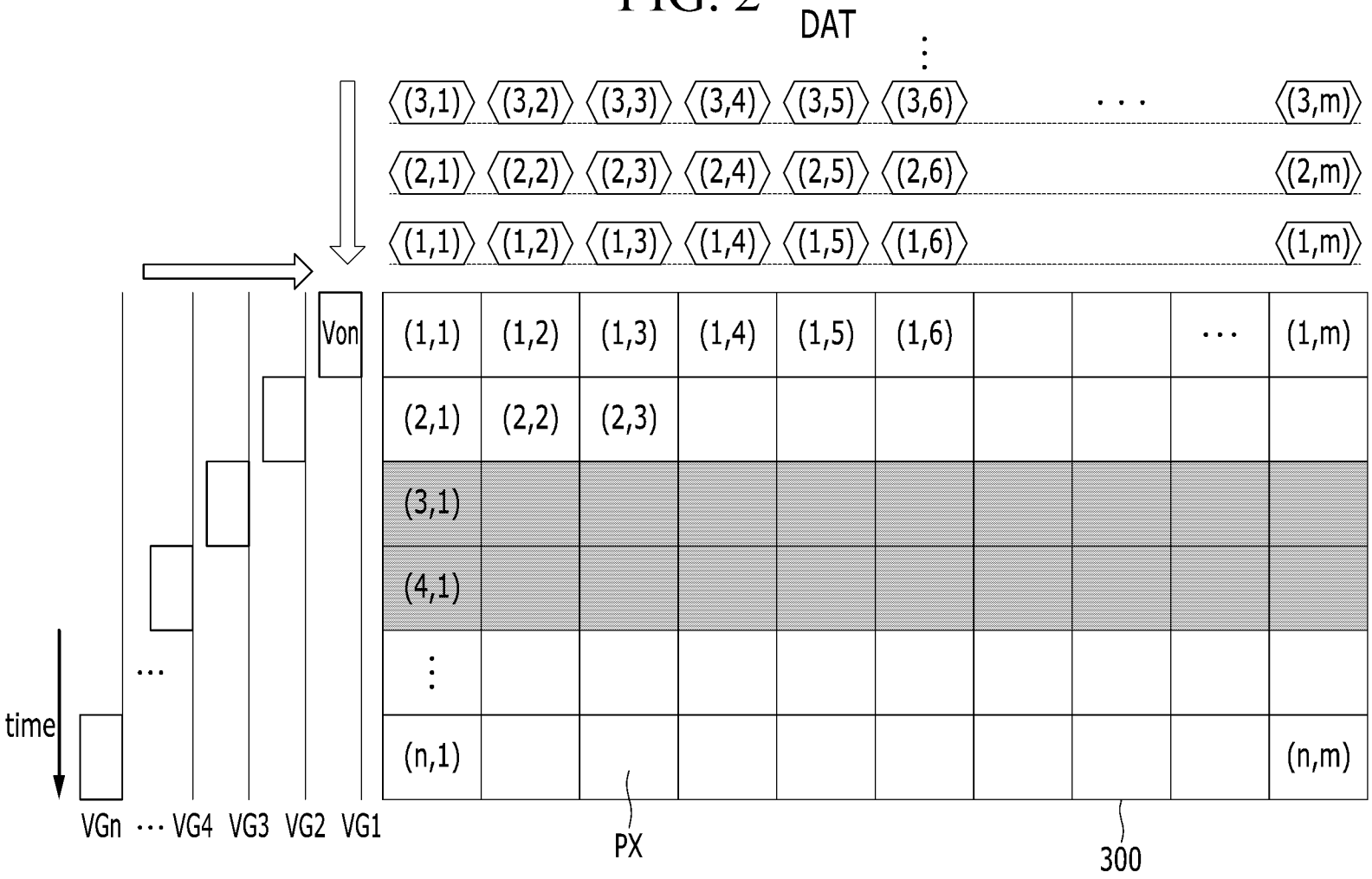
Figure 3:
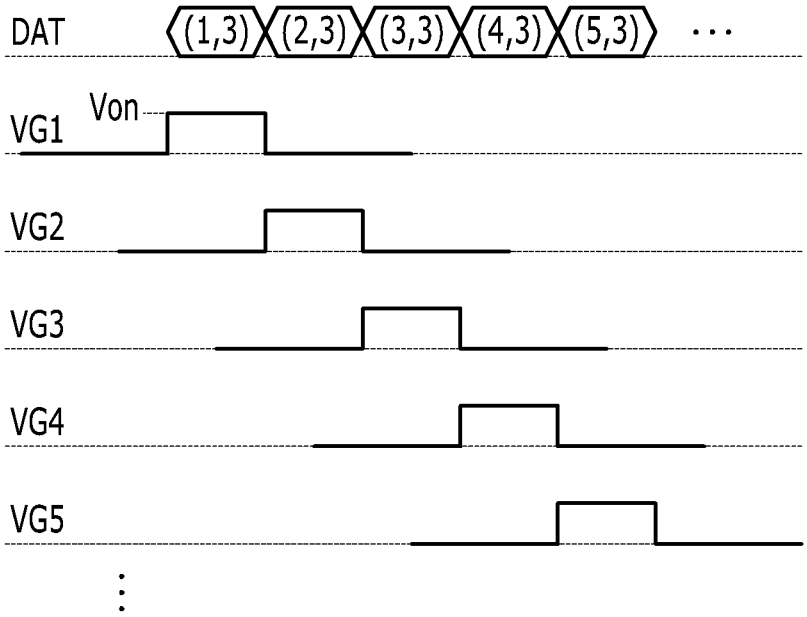

Referring to FIGS. 2 and 3, when operated by the gate doubling-off driving, the display device according to the example embodiment of the present invention transmits the output image data DAT corresponding to all the rows to the data driver 500, such that the corresponding data voltage Vd is input to the data lines D1 to Dm of the display panel 300.

In the display panel 300, (i,j) ($1 \le i \le n$, $1 \le j \le m$) represents a pixel PX connected to an i-th gate line Gi and a j-th data line Dj.

In addition, each output image data (i,j) represents the image data corresponding to a pixel (i,j).

That is, output image data (1,3) is image data corresponding to a pixel (1,3).

FIG. 3 illustrates example output image data (i,3) (i=1, 2, 3, . . . ) corresponding to a third pixel column (i,3) of various pixel columns.

The gate-on voltage Von is sequentially applied to the gate lines G1 to Gn.

Synchronized with output timing of the output image data (i,j), the gate-on voltage Von starts to be applied to each of the gate lines G1 to Gn that are connected to the corresponding pixels PX.

VGi represents the gate signal that is transmitted through the i-th gate line Gi, which will represent the same in the following.

A time for which the gate-on voltage Von is applied to each of the gate lines G1 to Gn may be approximately one horizontal period, but it is not limited thereto.

FIG. 2 and FIG. 3 illustrate an example in which gate-on voltage pulses of the gate signals VG1, VG2, . . . applied to the adjacent gate lines G1 to Gn do not substantially overlap each other, but the present invention is not limited thereto, and a pre-charge driving method in which the gate-on voltage pulses are applied in advance before a predetermined time may also be applied.

In this case, the gate-on voltage pulses applied to the adjacent gate lines G1 to Gn may overlap each other for some time, and the same voltage may be applied to the pixels PX that are connected to the corresponding gate lines G1 to Gn.

Accordingly, the data voltage Vd corresponding to the output image data (i,j) is transmitted to all the pixels PX such that the pixels PX are charged to display an image.

In this case, the displayed image may represent the same vertical resolution as the input image data DAT.

Now, a driving method according to a gate doubling scheme of a display device according to an example embodiment of the present invention will be described with reference to FIGS. 4 and 5.

In the driving method of the display device according to the example embodiment of the present invention, when operated by the gate doubling driving, reduced data with vertical resolution reduced by 1/k (k is a natural number of 2 or more) for one frame, for example, reduced data of odd-numbered rows (or reduced interpolation data of odd-numbered rows) or reduced data of even-numbered rows (or reduced interpolation data of even-numbered rows) may be input to the data driver 500, and may apply the corresponding data voltage Vd to the pixel PX.

In the current example embodiment, a case of outputting the reduced data of the odd-numbered rows to the data driver 500 will be described.

For example, output image data DAT corresponding to a third pixel column (i,3) are equal to (1,3), (3,3), (5,3), . . . because only the image data corresponding to the odd-numbered rows are extracted.

Figure 5:
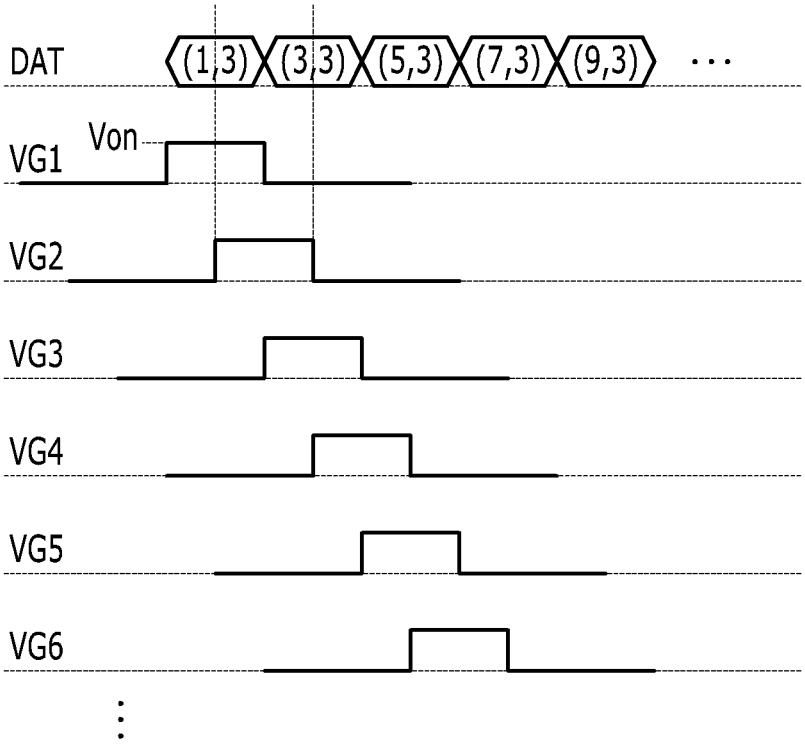

FIG. 5 illustrates an example of the output image data (i,3) (i=1, 3, 5, . . . ) corresponding to the third pixel column (i,3) among the various pixel columns.

In the driving method of the display device according to the example embodiment of the present invention, the gate-doubling driving in which two or more of the adjacent gate lines G1 to Gn are concurrently (e.g., simultaneously) operated is used, and times at which the gate-on voltage Von starts to be applied to at least two of the k adjacent gate lines G1 to Gn (k is a natural number of 2 or more) for transmitting the gate-on voltage Von in response to one output image data (i,j) may be different.

For example, in response to one output image data (i,j), the gate-on voltage pulse applied to at least some of the k gate lines for transmitting the gate-on voltage Von is shifted backward and forward in time.

In this case, in response to one output image data (i,j), at least one of the k adjacent gate lines G1 to Gn for transmitting the gate-on voltage Von may be synchronized with an output time of the output image data (i,j) such that it is applied with the gate-on voltage Von.

Figure 4:
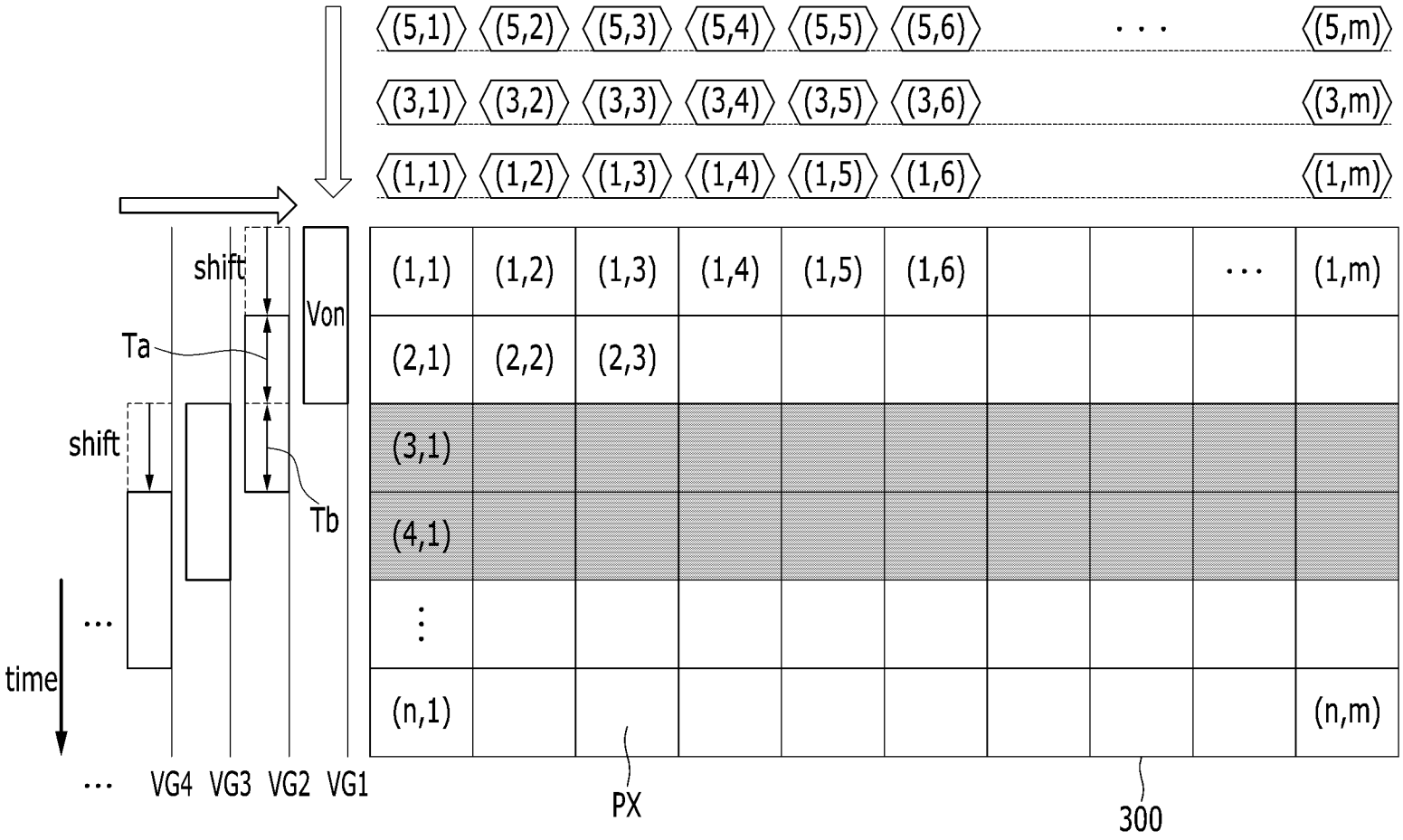

For example, Referring to FIGS. 4 and 5, the odd-numbered gate lines G1, G3, . . . may be applied with the gate-on voltage Von while being synchronized with an output timing of the output image data (i,j).

However, unlike as shown in the general gate-doubling driving, the gate-on voltage pulse applied to the even-numbered gate lines G2, G4, . . . may not be concurrently (e.g., simultaneously) applied to the previous odd-numbered gate lines G1, G3, . . . but is shifted forward in time to be applied in advance before the gate-on voltage Von starts to be applied to the odd-numbered gate lines G1, G3, . . . .

That is, times at which the gate-on voltage Von is applied to the even-numbered gate lines G2, G4, . . . may be between a time at which the gate-on voltage Von starts to be applied to the odd-numbered gate lines G1, G3, . . . right above the even-numbered gate lines and a time at which the gate-on voltage Von starts to be applied to the odd-numbered gate lines G1, G3, . . . right below the even-numbered gate lines.

Pulse widths of the gate-on voltage Von applied to all the gate lines G1 to Gn may be substantially the same, but they are not limited thereto.

In the current example embodiment, the gate-on voltage Von having a fixed pulse width will be described.

Accordingly, the data voltage of the output image data DAT for the pixels PX of the previous odd-numbered pixel rows and the data voltage of the output image data DAT for the pixels PX of the next odd-numbered pixel row may be temporally divided to be applied to the pixels PX connected to the even-numbered gate lines G2, G4, . . . .

For example, while one gate-on voltage pulse is maintained, the pixels PX of the third column connected to the second gate line G2 may be applied with the data voltage Vd of the output image data (1, 3) and then the data voltage Vd of the output image data (3, 3).

As such, the pixels PX connected to the even-numbered gate lines G2, G4, . . . are finally charged with interpolated values such as a temporal average of the two data voltages Vd to represent intermediate luminance of the two output image data DAT.

Accordingly, an effect of temporally interpolating the data voltages applied to the pixels PX connected to the even-numbered gate lines G2, G4, . . . may be substantially achieved.

A ratio of an overlap period Ta to a non-overlap period T of the gate-on voltage pulse applied to the previous even-numbered gate lines G2, G4, . . . with respect to the previous odd-numbered gate lines G1, G3, . . . may be appropriately adjusted.

The non-overlap period Tb becomes an overlap period with the gate-on voltage pulse that is applied to the next odd-numbered gate lines G3, G5, . . . .

For reference purpose, luminance values and lengths of the overlap and non-overlap periods Ta and Tb adjusted as such may be stored in a memory and the like that are included in the signal controller 600.

According to the example embodiment of the present invention, the length of the overlap period Ta may be different for different frames, and two or more frames having different overlap periods Ta may be alternated.

When a weight of W1:W2 is required for the output image data DAT of the previous odd-numbered row and the next odd-numbered row to allow the corresponding pixel PX to reach a target voltage, a ratio of the overlap period Ta to the non-overlap period Tb may be approximately W1:W2.

For example, when a temporal interpolation value of the data voltages Vd should be an average value, the ratio of Ta to Tb may be approximately 1:1.

Figure 6:
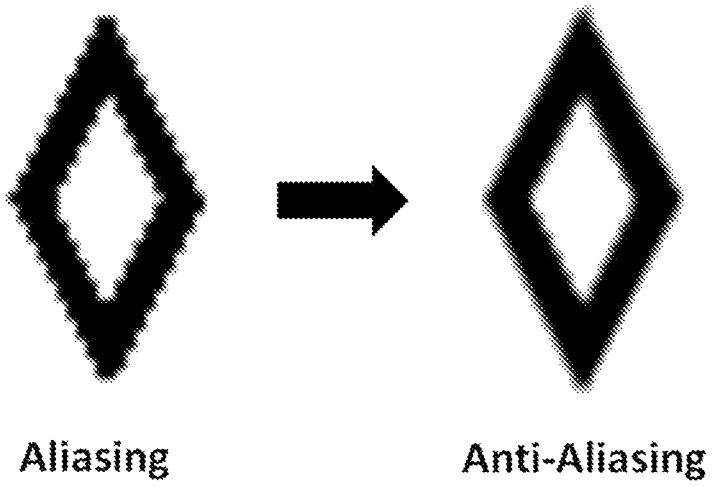

As illustrated in FIG. 6, when edges having shapes such as slanted lines, curves, and the like of an image to be displayed are represented by black and white, an aliasing effect may occur because the edges of the image look like step-like shapes due to degraded resolution even if the image is displayed by using the gate doubling driving method.

However, when the image is displayed in accordance with the driving method according to the example embodiment of the present invention, the pixels PX connected to the even-numbered gate lines G2, G4, . . . are charged with the voltages corresponding to the interpolated values of the output image data DAT for the pixels PX that are connected to the previous odd-numbered gate lines G1, G3, . . . and the next odd-numbered gate lines G1, G3, . . . .

Accordingly, edge portions of the image filled with luminance corresponding to a substantially intermediate value of different gray levels are generated.

Accordingly, as shown at a right side of FIG. 6, the step-like shapes are smoothed at the edge portions of the image to achieve an anti-aliasing effect, and may be perceived as—visually high resolution because the image is smoothed and the pixels PX do not look to stand out.

According to the example embodiment of the present invention, because the anti-aliasing effect of the high-resolution display device can be easily achieved even without additional circuits such as an image interpolation filter and the like, which may reduce costs.

In addition, using the interpolation in which the gate signals applied to the even-numbered gate lines G2, G4, . . . are shifted in time, because the pixels PX connected to the even-numbered gate lines G2, G4, . . . are charged with the voltages corresponding to two or more interpolated values of the output image data DAT, an effect of upscaling the output image data DAT can also be achieved to allow the high-resolution image to be viewed.

Until now, the description has been made for the current example embodiment in which only the gate signal applied to the even-numbered gate lines G2, G4, . . . are shifted, but the present invention is not limited thereto, and the pulse of the gate-on voltage applied to the odd-numbered gate lines G1, G3, . . . may be shifted backward in time to charge the pixels PX connected to the odd-numbered gate lines G1, G3, . . . with temporally interpolated voltages.

Next, a display device according to an example embodiment of the present invention and a driving method thereof will be described with reference to FIGS. 7 and 8.

The same components as the example embodiments described above designate the same reference numerals, and a repeated description will be omitted.

The driving method of the display device according to the example embodiment of the present invention is substantially the same as the aforementioned example embodiment illustrated in FIGS. 4 and 5, but the output image data DAT corresponding to every predetermined number of pixel rows may be shifted by at least one pixel PX to the left or right to be outputted to the data driver 500.

Figure 7:
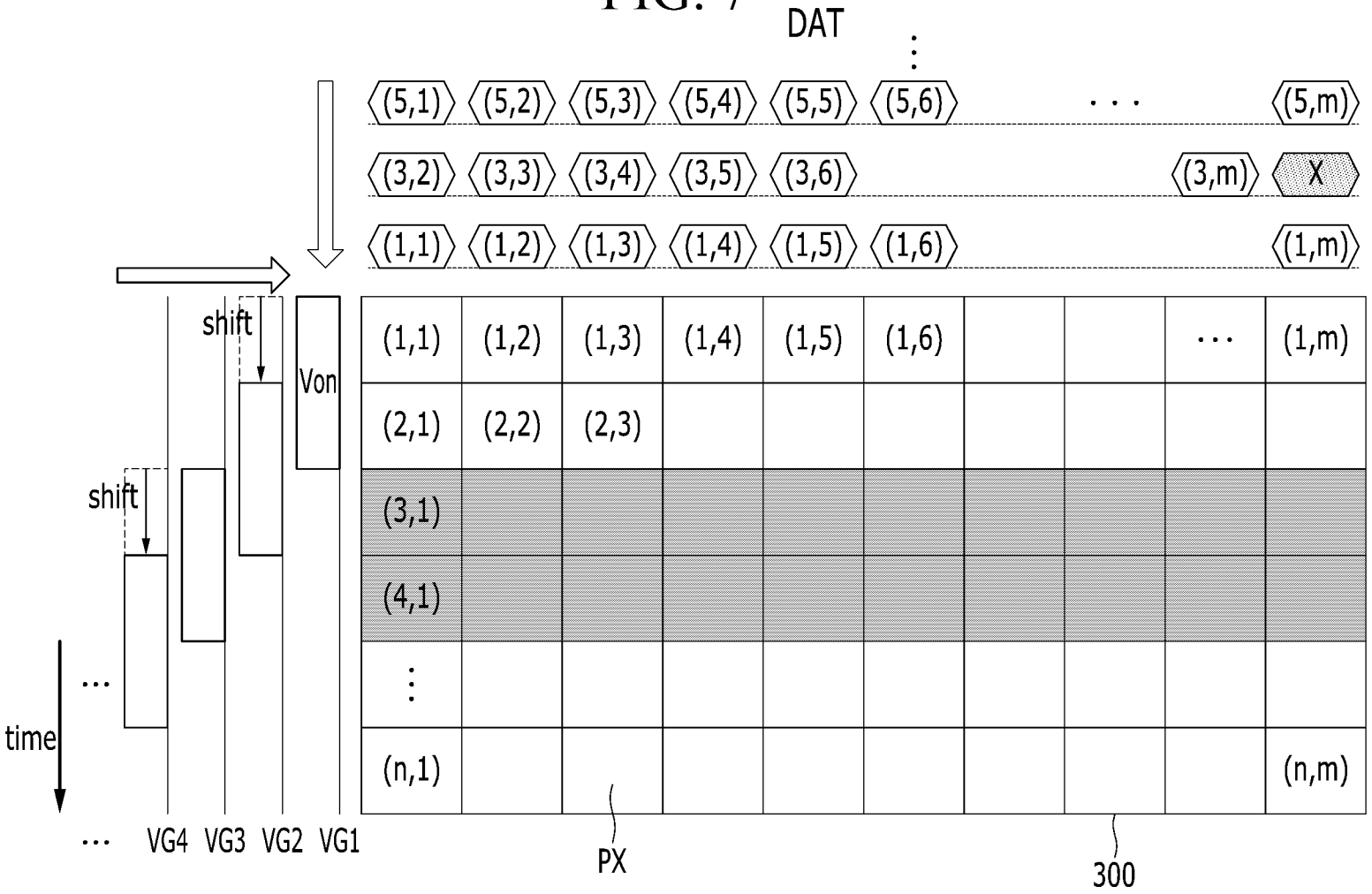

For example, as shown in FIG. 7, the output image data DAT for every two pixel rows, more specifically, the output image data DAT corresponding to the even-numbered rows, may be shifted to the right by at least one pixel PX to be outputted to the data driver 500.

For example, output image data DAT corresponding to a third pixel column (i,3) are (1,3), (3,4), (5,3), (7,4), . . . in sequence.

Figure 8:
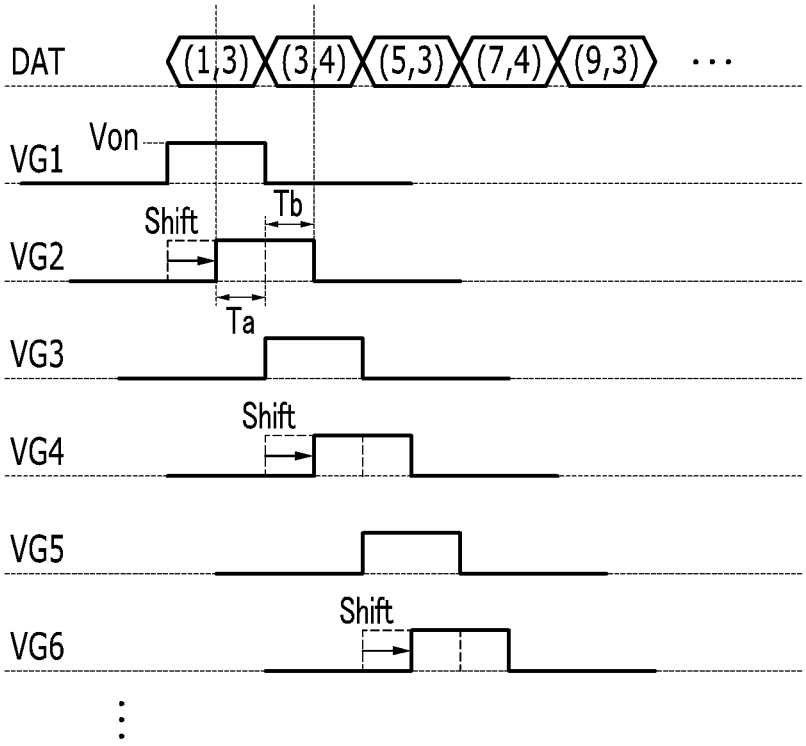

FIG. 8 illustrates an example of output image data (i,3) corresponding to the third pixel column (i,3) of the various pixel columns (i=1, 3, 5, . . . ).

According to the current example embodiment, the data voltage temporally divided to be applied to the pixels PX connected to the even-numbered gate lines G2, G4, . . . may be the data voltage of the output image data DAT for the previous odd-numbered pixel row and the pixels PX of the same pixel column and then the data voltage of the output image data DAT for the next odd-numbered pixel row and the pixels PX of the pixel column to the right.

For example, while one gate-on voltage pulse is maintained, a pixel (2,3) may be applied with a data voltage Vd of the output image data (1, 3) of the same pixel column and then a data voltage Vd of the output image data (3,4) of the pixel column to the right.

As such, the pixels PX connected to the even-numbered gate lines G2, G4, . . . are finally charged with interpolated values such as a temporal average of the two data voltages Vd to represent an intermediate luminance of the two output image data DAT, and a greater interpolation effect of the image can be achieved because the two data voltages Vd to be applied are the data voltages of the output image data DAT corresponding to at least two of the pixel columns.

Accordingly, the data voltages applied to the pixels PX connected to the even-numbered gate lines G2, G4, . . . may be temporally and spatially interpolated values of at least two of the output image data DAT such that the anti-aliasing effect is maximized and the edges of the image are smoothly displayed.

In this case, the aliasing effect may be simply reduced even without additional circuits such as an image interpolation filter and the like, thereby resulting in reduced cost.

According to the example embodiment of the present invention, the driving method according to the aforementioned example embodiment illustrated in FIGS. 4 and 5 and the driving method according to the example embodiment illustrated in FIGS. 7 and 8 may be alternated by at least one frame.

Alternatively, the image may be displayed for continuous frames according to each of the driving methods.

Unlike the current example embodiment, the output image data DAT may synchronize all of the gate-on voltage pulses applied to the k adjacent gate lines G1 to Gn that are concurrently (e.g., simultaneously) operated in the gate doubling driving.

That is, when each of the output image data DAT is outputted as in the general gate doubling driving, the gate-on voltage pulse may be concurrently (e.g., simultaneously) applied to the k adjacent gate lines G1 to Gn that are concurrently (e.g., simultaneously) operated.

Even in this case, the output image data DAT may be shifted to the left or right for every predetermined number of rows to simply reduce the aliasing effect.

Figure 9:
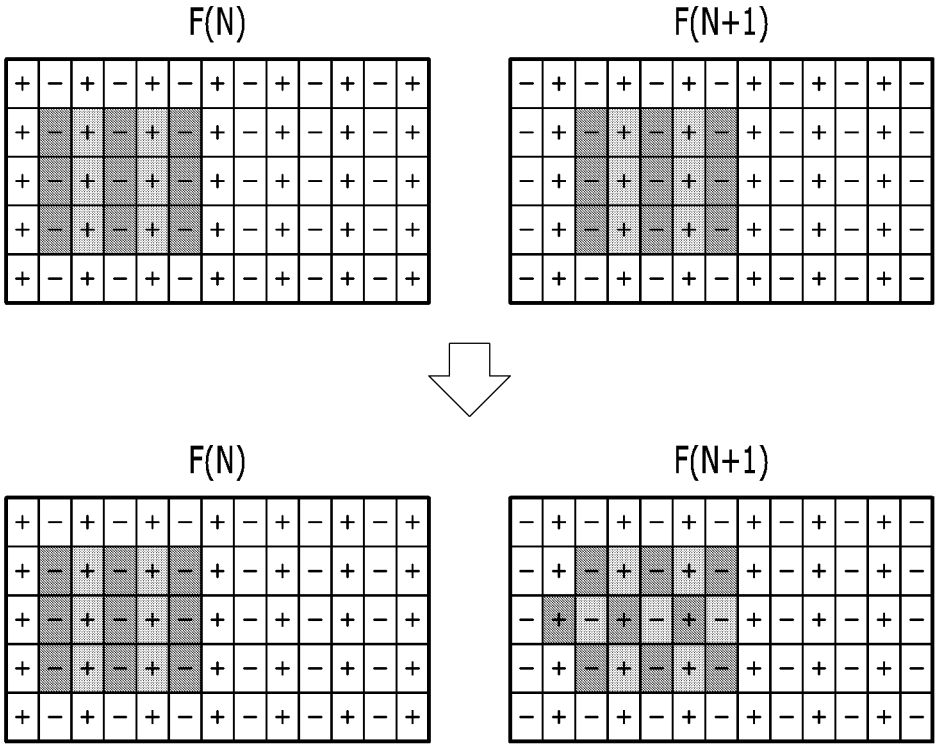

FIG. 9 illustrates that a moving vertical line generated when the display device according to the example embodiment of the present invention displays a specific image is removed by the driving method of the display device according to the example embodiment of the present invention.

Referring to FIG. 9, a single gray-level image is displayed in the display panel 300. When such an image is scrolled to move at a speed of one or two pixels PX for every frame, the moving vertical line as illustrated in an upper part of FIG. 9 may be recognized.

Particularly, in the LCD, when polarities of the data voltages Vd with respect to the common voltage Vcom are constant for every frame, the polarities of the data voltages Vd may be reversed for every frame to remove a residual image that can occur due to a DC bias generated in the liquid crystal layer, and column inversion driving in which the polarities of the data voltages Vd applied to the adjacent pixel column are inverted may be performed.

FIG. 9 illustrates an example of the polarities of the data voltages Vd applied to each pixel PX.

When a monochrome image of the same gray level is displayed in one frame F(N) and then the same image is shifted by one pixel PX to be displayed in the next frame F(N+1), the polarities of the pixels PX for displaying edge portions of the image may be identical to each other by the frame polarity inversion.

Then, because the same parts of the image are displayed to have the same polarities even in the different frames F(N) and F(N+1), an effect of the polarity inversion disappears and the vertical line can be recognized.

However, as in the example embodiment of the present invention, when the driving method according to the example embodiment illustrated in FIGS. 4 and 5 and the driving method according to the example embodiment illustrated in FIGS. 7 and 8 are alternated by at least one frame, the moving vertical line may become unrecognizable.

Referring to a lower part of FIG. 9, when driven according to the aforementioned example embodiment illustrated in FIGS. 4 and 5 in one frame F(N) and according to the illustrated example embodiment in the next frame F(N+1), the pixels PX for displaying the edges of the same image may be shifted to the left for every predetermined pixel row such that the images with the different polarities from those of the previous frame F(N) are displayed.

Accordingly, the moving image is not recognized as a moving vertical line.

Next, referring to FIGS. 10 and 11, a display device according to an example embodiment of the present invention and a driving method thereof will be described.

The same components as the example embodiments described above designate the same reference numerals, and a repeated description will be omitted.

The driving method of the display device according to the current example embodiment of the present invention is substantially the same as that of the aforementioned example embodiment illustrated in FIGS. 7 and 8, and output image data DAT corresponding to every predetermined number of pixel rows may be shifted to the right by at least one pixel PX to output them to the data driver 500.

Figure 10:
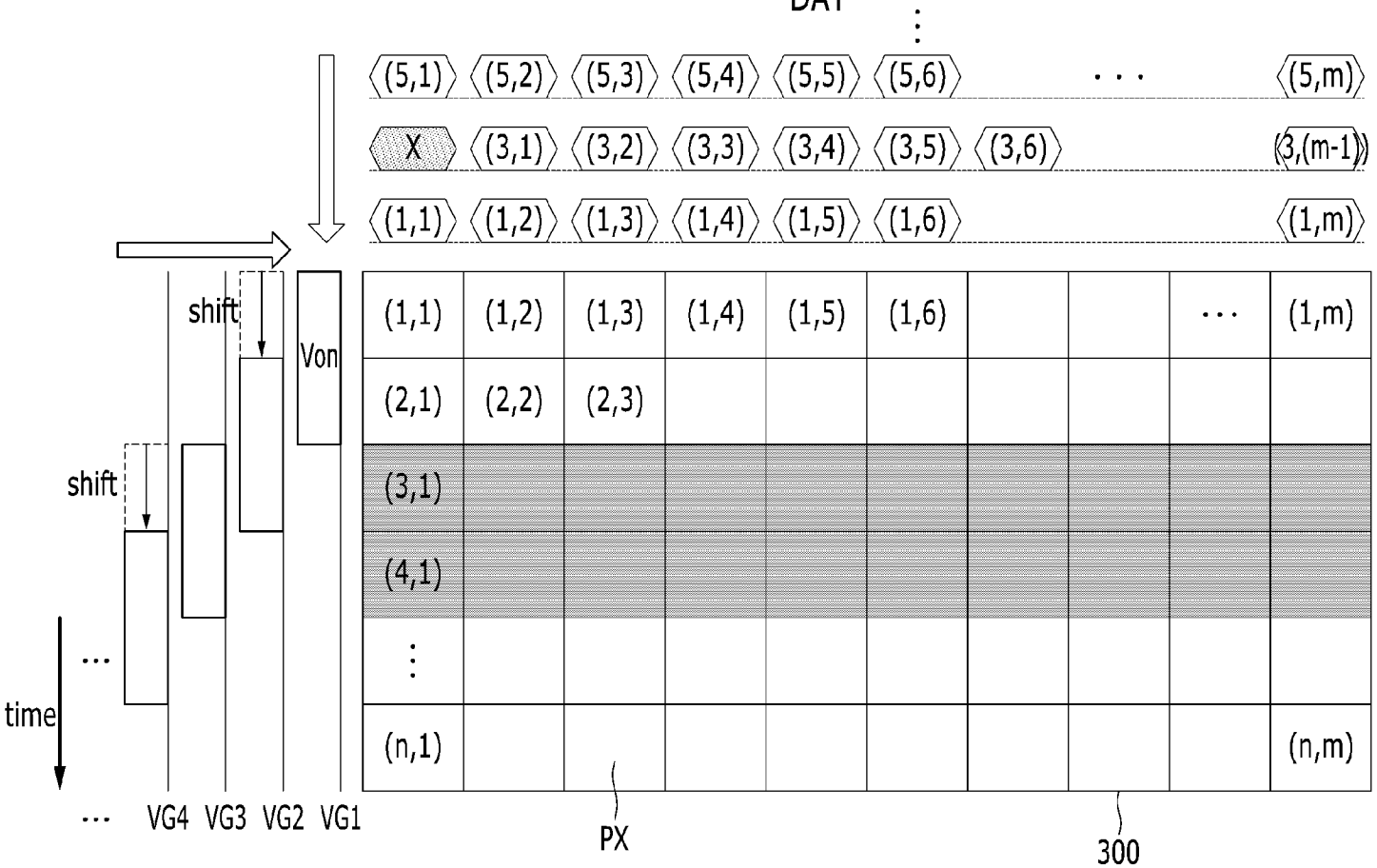

For example, as shown in FIG. 10, the output image data DAT for every two pixel rows, more specifically, the output image data DAT corresponding to the even-numbered rows, may be shifted by one pixel PX to the right to output them to the data driver 500.

For example, output image data DAT corresponding to a third pixel column (i,3) are (1,3), (3,2), (5,3), (7,2), . . . in sequence.

Figure 11:
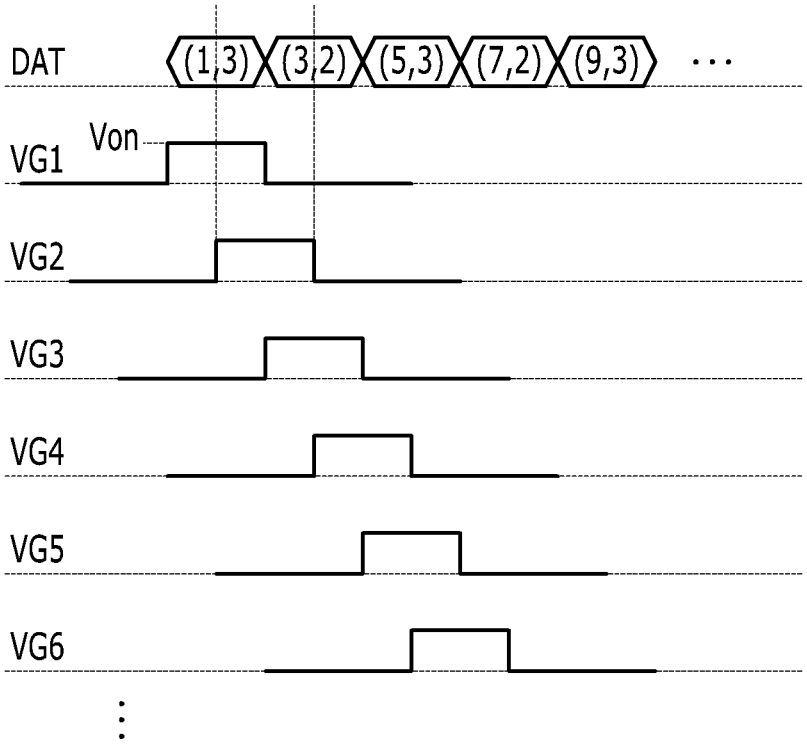

FIG. 11 illustrates an example of output image data (i,3) corresponding to the third pixel column (i,3) of the various pixel columns (i=1, 3, 5, . . . ).

According to the current example embodiment, a data voltage temporally divided to be applied to the pixels PX connected to the even-numbered gate lines G2, G4, . . . may be the data voltage of the output image data DAT for the previous odd-numbered pixel row and the pixels PX of the same pixel column, and may be the data voltage of the output image data DAT for the next odd-numbered pixel row and the pixels PX of the pixel column to the left.

For example, while one gate-on voltage pulse is maintained, a pixel (2,3) may be applied with a data voltage Vd of the output image data (1, 3) of the same pixel column and then a data voltage Vd of the output image data (3,2) of the pixel column to the left.

As such, the pixels PX connected to the even-numbered gate lines G2, G4, . . . are finally charged with interpolated values such as a temporal average of the two data voltages Vd to represent an intermediate luminance of the two output image data DAT, and a greater interpolation effect of the image may be achieved because the two data voltages Vd to be applied are the data voltages of the output image data DAT corresponding to at least two pixel columns.

Accordingly, the data voltages applied to the pixels PX connected to the even-numbered gate lines G2, G4, . . . may be temporally and spatially interpolated values of at least two of the output image data DAT such that the anti-aliasing effect is maximized and the edges of the image are smoothly displayed.

In this case, the aliasing effect may be simply reduced even without additional circuits such as an image interpolation filter and the like, thereby resulting in reduced cost.

According to the example embodiment of the present invention, the driving method according to the aforementioned example embodiment illustrated in FIGS. 4 and 5 and the driving method according to the example embodiment illustrated in FIGS. 10 and 11 may be alternated by at least one frame.

Alternatively, the image may be displayed for continuous frames according to each of the driving methods.

According to the example embodiment of the present invention, the driving method according to the aforementioned example embodiment illustrated in FIGS. 7 and 8 and the driving method according to the example embodiment illustrated in FIGS. 10 and 11 may be alternated by at least one frame.

According to the example embodiment of the present invention, the driving method according to the aforementioned example embodiment illustrated in FIGS. 4 and 5, the driving method according to the example embodiment illustrated in FIGS. 7 and 8, and the driving method according to the example embodiment illustrated in FIGS. 10 and 11 may alternate by at least one frame.

In this case, sequences of the different driving methods may be modified in various ways.

Figure 12:
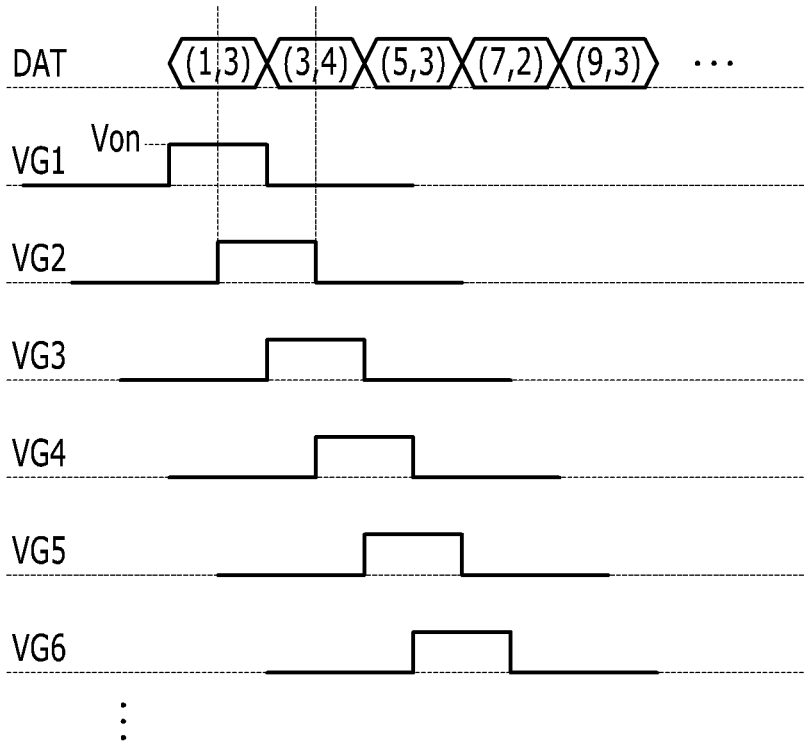
Figure 13:
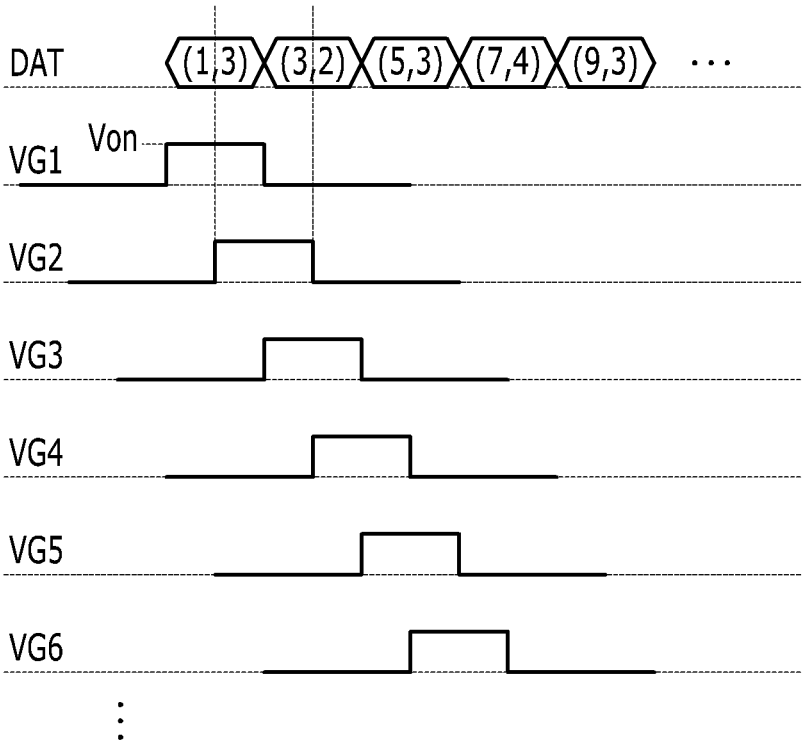

FIGS. 12 and 13 illustrate the output image data and the gate signal inputted to the display panel for one frame when the display device according to the example embodiment of the present invention is operated in the gate doubling driving.

Referring to FIG. 12, the driving method of the display device according to the current example embodiment of the present invention is substantially the same as the driving method according to the aforementioned example embodiment illustrated in FIGS. 7 and 8 or the driving method according to the example embodiment illustrated in FIGS. 10 and 11, and directions in which the output image data DAT corresponding to every predetermined number of pixel rows that are moved may not be fixed but may be alternated for one frame.

For example, as shown in FIG. 12, output image data DAT corresponding to a (4k−2)-th row (k=1, 2, . . . ) may be moved to the left, while output image data DAT corresponding to a 4k-th row may be moved to the right.

That is, the output image data DAT corresponding to the even-numbered rows may be moved to the left and right such that the even-numbered rows moved to the left and the even-numbered rows moved to the right may be alternated for every two pixel rows.

Referring to FIG. 12, output image data DAT corresponding to a third pixel column (i,3) are (1,3), (3,4), (5,3), (7,2), (9,3), . . . in sequence.

Accordingly, data voltages applied to the pixels PX of the even-numbered pixel rows may be variously mixed and interpolated to further increase an anti-aliasing effect.

Referring to FIG. 13, the driving method of the display device according to the example embodiment of the present invention is substantially the same as the example embodiment illustrated in FIG. 12, but the output image data DAT corresponding to the (4k−2)-th row (k=1, 2, . . . ) may be moved to the right while the output image data DAT corresponding to the 4k-th row may be moved to the left.

Referring to FIG. 13, output image data DAT corresponding to a third pixel column (i,3) are (1,3), (3,2), (5,3), (7,4), (9,3) . . . in sequence.

According to one example embodiment of the present invention, the driving method according to the aforementioned example embodiment illustrated in FIGS. 4 and 5 and the driving method according to the example embodiment illustrated in FIG. 12 or FIG. 13 may be alternated by at least one frame.

Next, a driving method of a display device according to an example embodiment of the present invention will be described with reference to FIGS. 14 to 16.

The same components as the example embodiments described above designate the same reference numerals, and a repeated description will be omitted.

Figure 14:
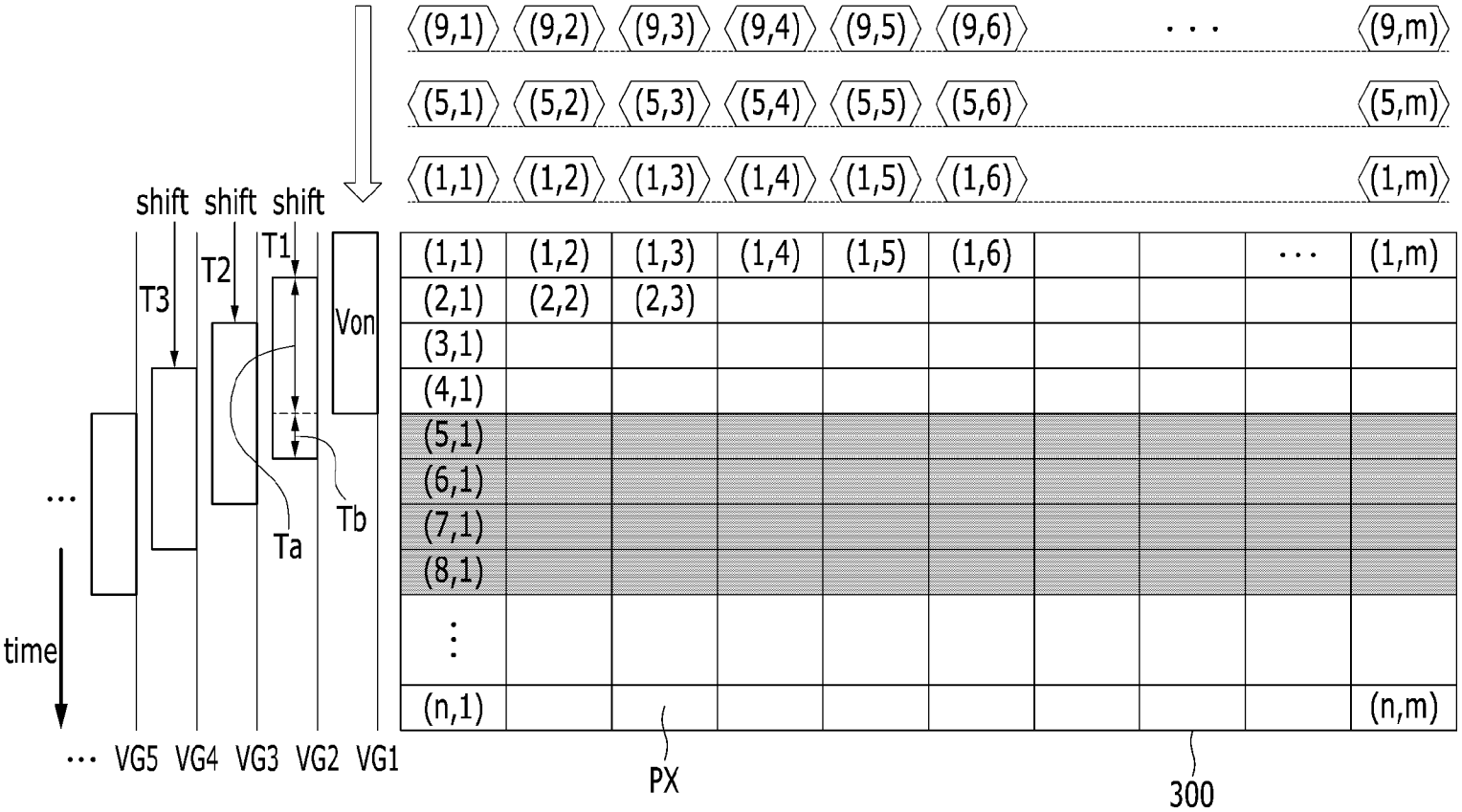

First, referring to FIG. 14, the driving method of the display device according to the current example embodiment is substantially the same as the aforementioned example embodiment illustrated in FIGS. 4 and 5, but a degree of image data reduction and the number of gate lines G1 to Gn that are concurrently (e.g., simultaneously) operated may be different.

Specifically, reduced data with vertical resolution reduced to ¼ for one frame, for example, reduced data of a (4k−3)-th row (k is a natural number of 1 or more (or reduced interpolated data), reduced data of a (4k−2)-th row (or reduced interpolated data), reduced data of a (4k−1)-th row (or reduced interpolated data), or a 4k-th row reduced data (or reduced interpolated data), may be input to the data driver 500, and corresponding data voltages Vd may be applied to the pixels PX.

In the current example embodiment, a case in which the reduced data of the (4k−3)-th row (k is a natural number of 1 or more) is outputted to the data driver 500 will now be described.

For example, output image data DAT corresponding to a third pixel column (i,3) are (1,3), (5,3), (9,3), . . . in sequence.

In the driving method of the display device according to the current example embodiment of the present invention, the gate-doubling driving in which four of the adjacent gate lines G1 to Gn are concurrently (e.g., simultaneously) driven may be allowed, and times at which the gate-on voltage Von starts to be applied to at least two of four adjacent gate lines G1 to Gn for transmitting the gate-on voltage Von in response to one output image data (i,j) may be different.

More specifically, gate-on voltage pulses applied to at least some of the four gate lines for transmitting the gate-on voltage Von in response to one output image data (i,j) are shifted backward or forward in time.

In this case, at least one of the four adjacent gate lines G1 to Gn for transmitting the gate-on voltage Von in response to one output image data (i,j) may be synchronized with output timing of the output image data (i,j) such that it is applied with the gate-on voltage Von.

The gate-on voltage Von may be applied to the (4k−3)-th gate lines G1, G5, . . . (k=1, 2, 3, . . . ) while being synchronized with the output time of the output image data DAT.

However, the gate-on voltage pulses subsequently applied to the (4k−2)-th gate lines G2, G6, . . . , the (4k−1)-th gate lines G3, G7, . . . , and the 4k-th gate lines G4, G8, . . . are not concurrently (e.g., simultaneously) applied along with the (4k−3)-th gate lines G1, G5, . . . but may be shifted backward in time, such that they are applied before the gate-on voltage Von starts to be applied to the next (4k−3)-th gate lines G1, G3, . . . (k=2, 3, . . . ).

Shifted times T1, T2, and T3 from a time at which the gate-on voltage pulses are initially applied to the (4k−3)-th gate lines G1, G5, . . . to a time at which the gate-on voltage pulses are respectively initially applied to the (4k−2)-th gate lines G2, G6, . . . , the (4k−1)-th gate lines G3, G7, . . . , and the 4k-th gate lines G4, G8, . . . may be different and may be gradually increased.

For example, when an application time of one gate-on voltage pulse is set to 1H, the shifted times T1, T2, and T3 may approximate H/4, 2H/4, and 3H/4, respectively.

Accordingly, the pixels PX connected to the (4k−2)-th gate lines G2, G6, . . . , the (4k−1)-th gate lines G3, G7, . . . , and the 4k-th gate lines G4, G8, . . . may temporally divide the data voltage of the output image data DAT for the pixels PX connected to the 4k-th gate lines G1, G5, . . . and the data voltage of the output image data DAT for the pixels PX connected to the next 4k-th gate line (G5, G9, . . . ), thereby being applied with the data voltages.

For example, while one gate-on voltage pulse is maintained, a pixel (2,3) of a third column connected to a second gate line G2 may be applied with a data voltage Vd of the output image data (1, 3) and then the data voltage Vd of the output image data (5,3), and is finally charged with an interpolation value such as a temporal average of two data voltages Vd to represent intermediate luminance of the two output image data DAT.

In this case, the luminance may be adjusted by differentiating an overlap period Ta and a non-overlap period Tb of the gate-on voltage pulse that is applied to each of the gate lines G1 to Gn connected to the corresponding pixel row.

Accordingly, an effect of temporally interpolating the data voltages applied to the pixels PX connected to the (4k−2)-th gate lines G2, G6, . . . , the (4k−1)-th gate lines G3, G7, . . . , and the 4k-th gate lines G4, G8, . . . may be achieved.

Accordingly, an anti-aliasing effect can be achieved and resolution degradation can be suppressed.

Figure 15:
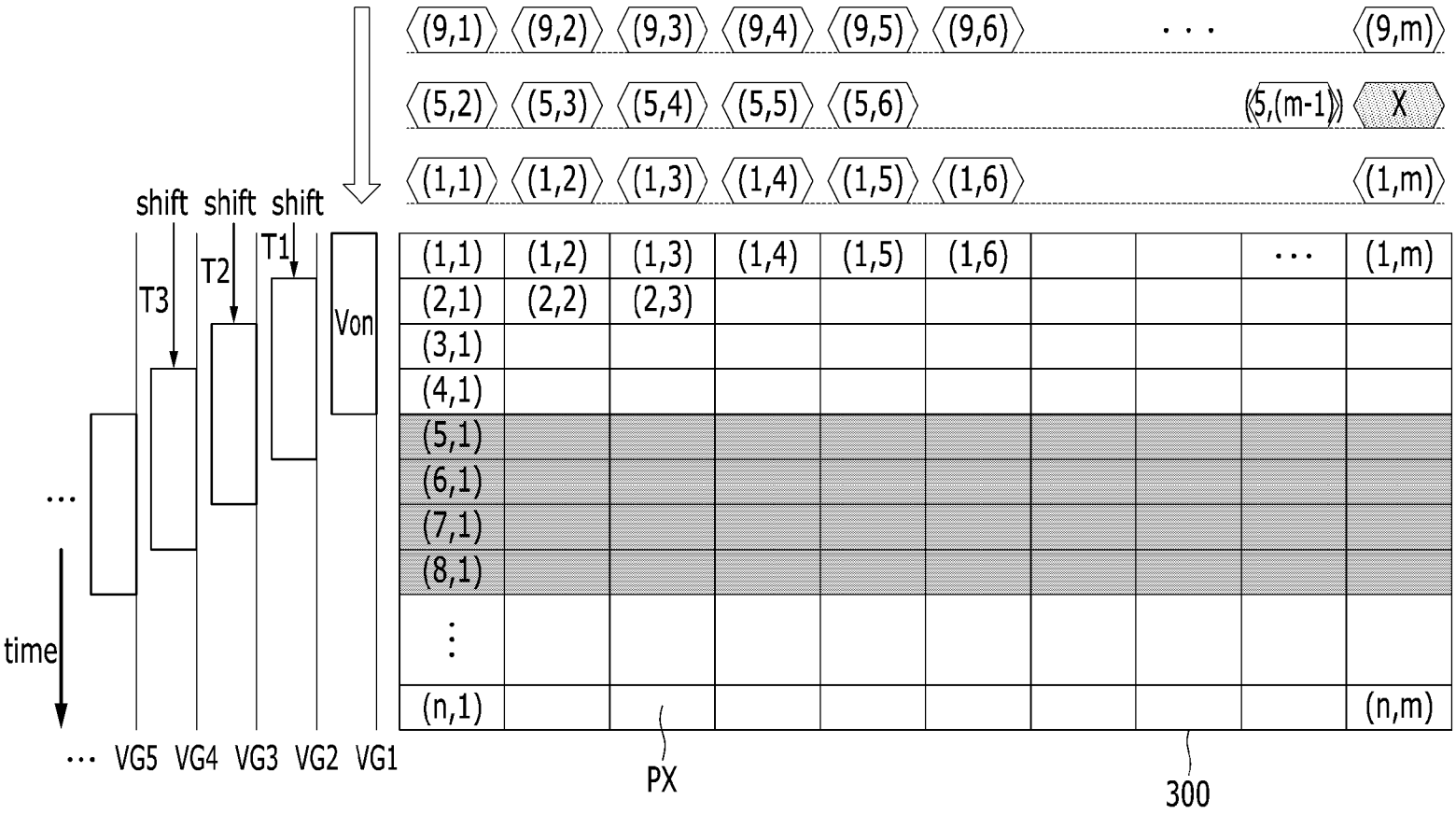

Next, referring to FIG. 15, a driving method of a display device according to the current example embodiment is substantially the same as the example embodiment illustrated in FIG. 14, but output image data DAT corresponding to every predetermined number of pixel rows may be shifted by at least one pixel PX to the left or right to be outputted to the data driver 500.

For example, output image data DAT corresponding to every two rows of reduced output image data DAT, more specifically, the output image data DAT corresponding to the (4k+1)-th pixel row (k=1, 2, . . . ), may be shifted to the right by at least one pixel PX to output them to the data driver 500.

For example, output image data DAT corresponding to a third pixel column (i,3) are (1,3), (5,4), (9,3), . . . in sequence.

According to the current example embodiment, a data voltage temporally divided to be applied to the pixels PX connected to the (4k−2)-th gate lines G2, G6, . . . , the (4k−1)-th gate lines G3, G7, . . . , and the 4k-th gate lines G4, G8, . . . may be the data voltage of the output image data DAT for the previous (4k−3)-th pixel row (k=1, 2, . . . ) and the pixels PX of the same pixel column, and may then be the data voltage of the output image data DAT for the next (4k−3)-th pixel row (k=2, 3, . . . ) and the pixels PX of the pixel column to the right.

According to one example embodiment of the present invention, the driving method according to the example embodiment illustrated in FIG. 14 and the driving method according to the example embodiment illustrated in FIG. 15 that are described above may be alternated by at least one frame.

Alternatively, the image may be displayed for continuous frames according to each of the driving methods.

Figure 16:
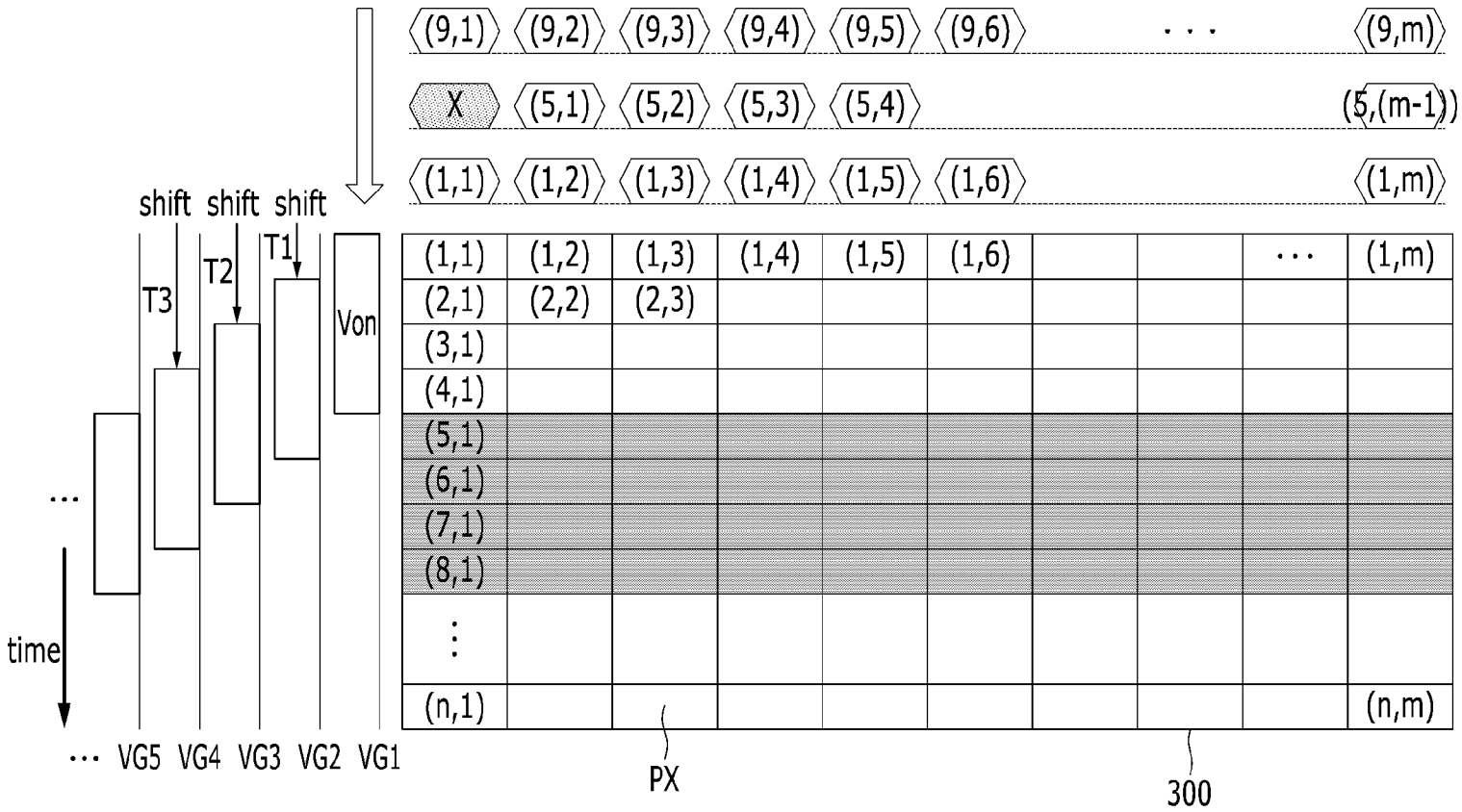

Next, referring to FIG. 16, a driving method of a display device according to the current example embodiment is substantially the same as the example embodiment illustrated in FIG. 14, but output image data DAT corresponding to every predetermined number of pixel rows may be shifted to the right by at least one pixel PX to output them to the data driver 500.

For example, output image data DAT of reduced output image data DAT for every two rows, more specifically, output image data DAT corresponding to a (4k+1)-th (k=1, 2, . . . ) pixel row, may be shifted to the right by at least one pixel PX to output them to the data driver 500.

For example, output image data DAT corresponding to a third pixel column (i,3) are (1,3), (5,2), (9,3), . . . in sequence.

According to the current example embodiment, a data voltage temporally divided to be applied to the pixels PX connected to the (4k−2)-th gate lines G2, G6, . . . , the (4k−1)-th gate lines G3, G7, . . . , and the 4k-th gate lines G4, G8, . . . may be the data voltage of the output image data DAT for the previous (4k−3)-th (k=1, 2, . . . ) pixel row and the pixels PX of the same pixel column, and may then be the data voltage of the output image data DAT for the next (4k−3)-th (k=2, 3, . . . ) pixel row and the pixels PX of the pixel column to the left.

According to one example embodiment of the present invention, the driving method according to the example embodiment illustrated in FIG. 14 and the driving method according to the example embodiment illustrated in FIG. 16 that are described above may be alternated by at least one frame.

Alternatively, the image may be displayed for continuous frames according to each of the driving methods.

According to the example embodiment of the present invention, the driving method according to the example embodiment illustrated in FIG. 15 and the driving method according to the example embodiment illustrated in FIG. 16 that are described above may be alternated by at least one frame.

According to the example embodiment of the present invention, the driving method according to the example embodiment illustrated in FIG. 14, the driving method according to the example embodiment illustrated in FIG. 15, and the driving method according to the example embodiment illustrated in FIG. 6 may be alternated by at least one frame.

In this case, sequences of the different driving methods may be modified in various ways.

Now, a display device according to an example embodiment of the present invention and a driving method thereof will be described with reference to FIGS. 17 and 18 along with the aforementioned drawings.

Figure 17:
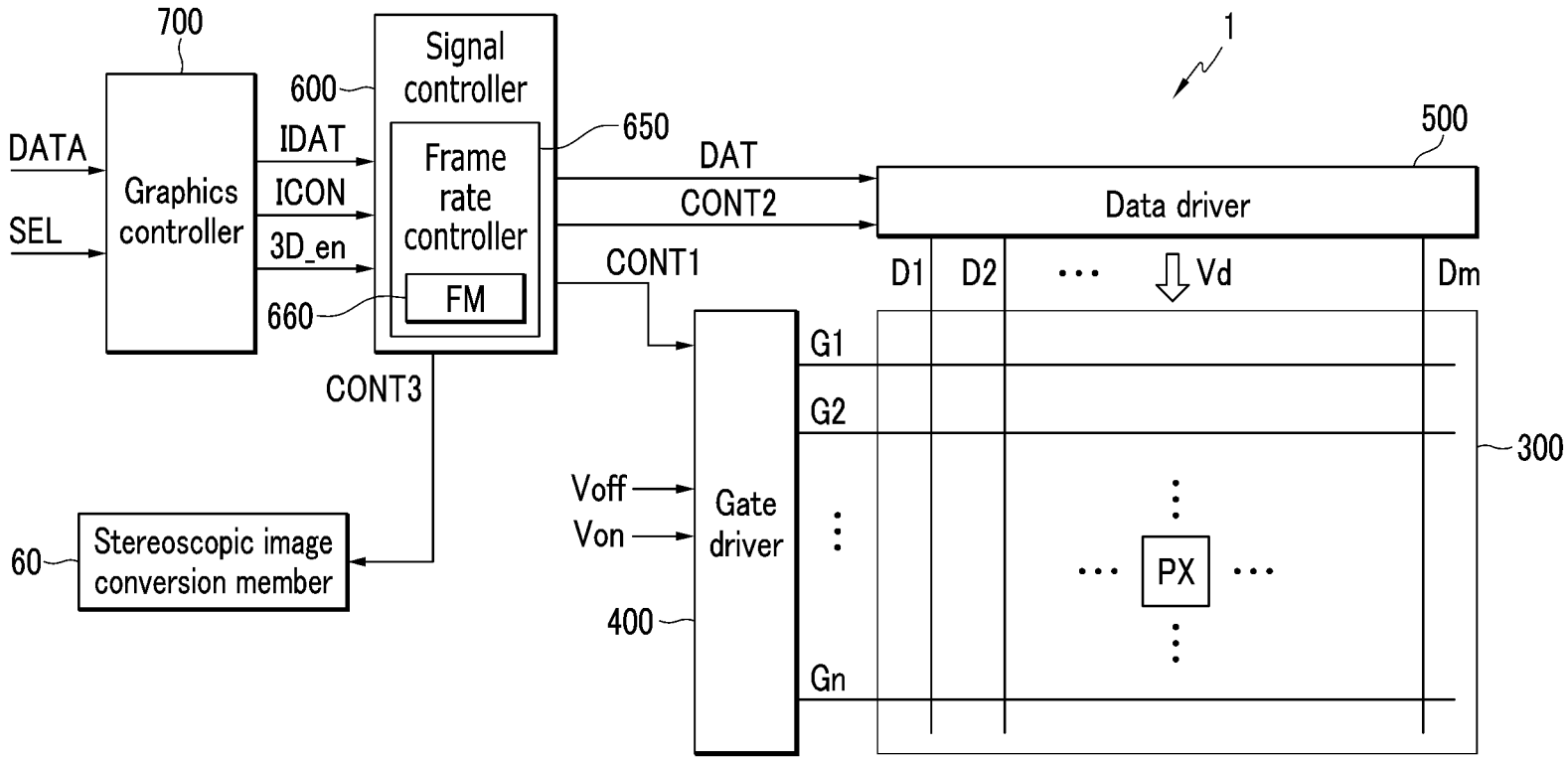

Referring to FIG. 17, the display device 1 according to the example embodiment of the present invention is substantially the same as the display device 1 according to the example embodiment illustrated in FIG. 1, but may further include a graphics controller 700 and a stereoscopic image conversion member 60.

Only differences will be described compared with the aforementioned example embodiments.

The graphics controller 700 may receive image information DATA, mode selection information SEL, and the like from the outside.

The mode selection information SEL may contain selection information about 2D and 3D modes and the like such as whether to display an image in a 2D or 3D mode.

The graphics controller 700 generates an input control signal ICON for controlling the input image data IDAT and display of the input image data IDAT based on the image information DATA and the mode selection information SEL.

The graphics controller 700 may generate a 3D enable signal 3D_en when the mode selection information SEL includes information for selecting the 3D mode.

The input image data IDAT, the input control signal ICON, and the 3D enable signal 3D_en may be transmitted to the signal controller 600.

The 3D enable signal 3D_en may instruct the display device to operate in the 3D mode such that a stereoscopic image is displayed, and may be omitted.

The signal controller 600 generates a stereoscopic image control signal CONT3 and the like in addition to the gate control signal CONT1 and the data control signal CONT2.

The signal controller 600 transmits the stereoscopic image control signal CONT3 to the stereoscopic image conversion member 60.

The signal controller 600 may operate in the 2D mode for displaying a 2D image or 3D mode for displaying a 3D image according to the 3D enable signal 3D_en that is received from the graphics controller 700.

In the 3D mode, the output image data DAT may include image signals of different viewpoints.

In the 3D mode, one pixel PX of the display panel 300 may display the data voltages corresponding to the image signals of the different viewpoints, or the different pixels PX may display the data voltages corresponding to the image signals of the different viewpoints.

The stereoscopic image conversion member 60 is provided to implement display of the stereoscopic image, such that the images corresponding to each viewpoint can be recognized at different viewpoints.

The stereoscopic image conversion member 60 may be operated while being synchronized with the display panel 300.

For example, the stereoscopic image conversion member 60 may allow an image for the left eye (referred to as a "left eye image") to be incident on a left eye of the viewer while allowing an image for the right eye (referred to as a "right eye image") to be incident on the right eye, thereby creating binocular disparity.

That is, the stereoscopic image conversion member 60 allows the different images to be respectively received at the different viewpoints, such that the viewer can perceive depth perception.

Figure 18:
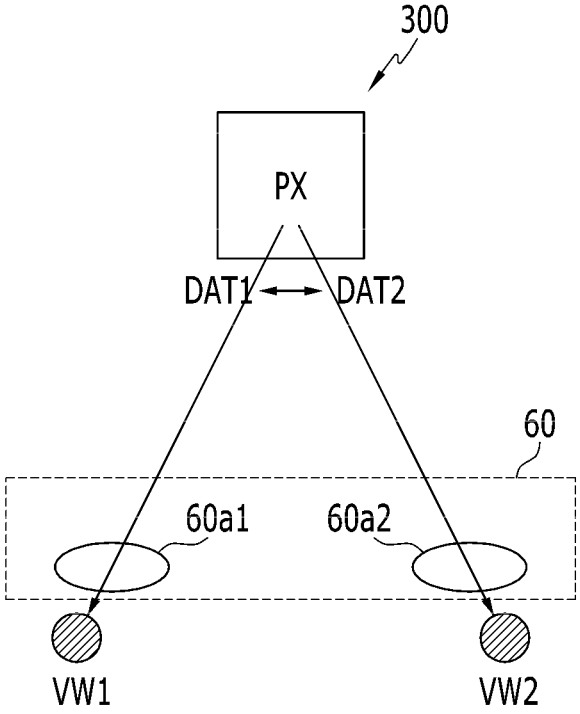
FIG. 18 is a drawing for illustrating a method in which the display device according to the example embodiment of the present invention displays a stereoscopic image using glasses.

Referring to FIG. 18, the stereoscopic image conversion member 60 may include shutter glasses 60*a*1 and 60*a*2 for enabling both eyes of one viewer to view the different images.

The pixel PX of the display panel 300 may display output image data DAT1 for a first viewpoint VW1 and output image data DAT2 for a second viewpoint VW2 at different times, and the viewer may view each of the images at the different viewpoints, that is, the first viewpoint VW1 and the second viewpoint VW2, through the shutter glasses 60*a*1 and 60*a*2 that are operated while being synchronized with the display panel 300.

The shutter glasses 60*a*1 of the first viewpoint VW1 and the shutter glasses 60*a*2 of the second viewpoint VW2 may be turned on and off with different timing.

In the stereoscopic 3D image display device, different viewers may respectively view the images at the first viewpoint VW1 and the second viewpoint VW2 through the shutter glasses 60*a*1 and 60*a*2, or the left and right eyes of one viewer may view the left eye image and the right eye image at the first viewpoint VW1 and the second viewpoint VW2 through the shutter glasses 60*a*1 and 60*a*2.

For example, when the display panel 300 alternatingly displays the left eye image corresponding to the first viewpoint VW1 and the right eye image corresponding to the second viewpoint VW2, the shutter glasses 60*a*1 and 60*a*2 may be synchronized thereto to alternatingly transmit or block light.

Then, the viewer may perceive the image of the display panel 300 as the stereoscopic image through the shutter glasses 60*a*1 and 60*a*2.

As such, even if display device alternatingly displays the images of the different viewpoints, the driving methods according to the aforementioned various example embodiments can be applied to alleviate the aliasing effect that can occur in the stereoscopic image.

In the timing diagram of the aforementioned example embodiment, although a pre-charge case is not described but a pre-charge driving method in which the gate-on voltage pulse is applied before a predetermined time to secure a charge rate of the data voltage can be concurrently (e.g., simultaneously) applied.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims and their equivalents.

DESCRIPTION OF SOME OF THE SYMBOLS

| | |
|---|---|
| 60: stereoscopic image conversion member | 60a: shutter glasses |
| 300: display panel | |
| 400: gate driver | 500: data driver |
| 600: signal controller | 660: frame memory |
| 700: graphics controller | |

What is claimed is:

1. A driving method of a display device, the display device comprising:

a plurality of gate lines;

a plurality of data lines;

a plurality of pixels comprising switching elements coupled to the gate and data lines;

a data driver;

a gate driver; and a signal controller configured to control the data driver and the gate driver, the method comprising:

generating output image data by the signal controller by either compressing vertical resolution of input image data of one frame by 1/k (k is a natural number) or receiving input image data with its vertical resolution compressed by 1/k and processing the input image data to generate output image data such that the output image data corresponding to every predetermined number of pixel rows is shifted left or right by a same number of at least one pixel and is output to the data driver in a first frame, wherein the predetermined number of pixel rows is greater than one pixel row and less than a total number of the pixel rows and all of the predetermined number of pixel rows are spaced apart from each other;

generating a data voltage based on the output image data by the data driver to apply the data voltage to the data line; and applying gate-on voltage pulses to k adjacent gate lines by the gate driver corresponding to respective image data of the output image data, wherein a timing at which the gate-on voltage pulse is applied to the gate line connected to a pixel row between two adjacent pixel rows among the pixel rows corresponding to the output image data is different according to a weight for the output image data of the two pixel rows.

2. The driving method of claim 1, wherein the output image data corresponding to the predetermined number of pixel rows are shifted left or right by at least one pixel and are output to the data driver.

3. The driving method of claim 2, wherein the predetermined number of the pixel rows is 2k (k is a natural number of 1 or more).

4. The driving method of claim 2, wherein the output image data is shifted left or right for the first frame.

5. The driving method of claim 4, wherein a frame where the output image data is shifted left and a frame where the output image data is shifted right are alternated by at least one frame.

6. The driving method of claim 4, wherein, in a second frame, the output image data corresponding to the pixels rows are not shifted left or right.

7. The driving method of claim 6, wherein the first frame and the second frame are alternated for at least one frame.

8. The driving method of claim 6, wherein a frame where the output image data are shifted left, a frame where the output image data are shifted right, and the second frame are alternated.

9. The driving method of claim 2, wherein, for the first frame, the output image data shifted left and the output image data shifted right among the output data shifted in the first frame are alternated in a column direction.

10. The driving method of claim 9, wherein, in a second frame, the output image data corresponding to all of the pixels rows are not shifted left or right.

11. The driving method of claim 10, wherein the first frame and the second frame are alternated for at least one frame.

12. The driving method of claim 1, wherein, in the first frame, the gate-on voltage pulses are applied to at least two of the k adjacent gate lines at different times.

13. The driving method of claim 12, wherein the output image data comprises first output image data and second output image data that are sequentially output, the k adjacent gate lines for transmitting the gate-on voltage pulses corresponding to the first output image data comprises a first gate line and a second gate line, the k adjacent gate lines for transmitting the gate-on voltage pulses corresponding to the second output image data comprises a third gate line and a fourth gate line, and a time at which the gate-on voltage pulse begins to be applied to the second gate line is between a time at which the gate-on voltage pulse begins to be applied to the first gate line and a time at which the gate-on voltage pulse begins to be applied to the third gate line.

14. The driving method of claim 13, wherein the first gate line transmits the gate-on voltage pulse while being synchronized with an output time of the first output image data, and the third gate line transmits the gate-on voltage pulse while being synchronized with an output time of the second output image data.

15. The driving method of claim 14, wherein the output image data comprises compressed data of odd-numbered rows or compressed interpolated data of the odd-numbered rows, the compressed data of the odd-numbered rows are generated by extracting the odd-numbered rows of the input image data, and the compressed interpolated data of the odd-numbered rows is generated by interpolating input image data of even-numbered rows before the odd-numbered rows and the input image data of the even-numbered rows after the odd-numbered rows.

16. The driving method of claim 13, wherein lengths of overlap periods of the gate-on voltage pulse applied to the second gate line and the gate-on voltage pulse applied to the first gate line are different in adjacent frames.

17. A display device comprising:

a plurality of gate lines and a plurality of data lines;

a plurality of pixels comprising switching elements coupled to the gate and data lines;

a signal controller configured to generate output image data by compressing vertical resolution of input image data of one frame to 1/k (k is a natural number) or receiving input image data with the vertical resolution compressed by 1/k and processing the input image data to generate output image data;

a data driver configured to generate a data voltage based on the output image data to apply the data voltage to the data line; and a gate driver configured to apply a gate-on voltage pulse to k adjacent gate lines corresponding to respective image data of the output image data, wherein the signal controller shifts the output image data corresponding to every predetermined number of pixel rows of the output image data left or right by a same number of at least one pixel to output it to the data driver in a first frame, wherein the predetermined number of pixel rows is greater than one pixel row and less than a total number of the pixel rows and all of the predetermined number of pixel rows are spaced apart from each other, and wherein a timing at which the gate-on voltage pulse is applied to the gate line connected to a pixel row between two adjacent pixel rows among the pixel rows corresponding to the output image data is different according to a weight for the output image data of the two pixel rows.

18. The display device of claim 17, wherein the output image data corresponding to the predetermined number of pixel rows are shifted left or right by at least one pixel and are output to the data driver.

19. The display device of claim 18, wherein the predetermined number of the pixel rows is 2k pixel rows (k is a natural number of 1 or more).

20. The display device of claim 19, wherein in the first frame, the gate-on voltage pulse is applied to at least two gate lines of the k adjacent gate lines at different times.

21. The display device of claim 20, wherein the output image data comprises first output image data and second output image data that are sequentially outputted, the k adjacent gate lines for transmitting the gate-on voltage pulses corresponding to the first output image data comprise a first gate line and a second gate line, the k adjacent gate lines for transmitting the gate-on voltage pulses corresponding to the second output image data comprises a third gate line and a fourth gate line, and a time at which the gate-on voltage pulse begins to be applied to the second gate line is between a time at which the gate-on voltage pulse begins to be applied to the first gate line and a time at which the gate-on voltage pulse begins to be applied to the third gate line.

* * * * *